US006543238B2

(12) United States Patent
Yamanaka et al.

(10) Patent No.: US 6,543,238 B2
(45) Date of Patent: Apr. 8, 2003

(54) REFRIGERANT CYCLE SYSTEM WITH EXPANSION ENERGY RECOVERY

(75) Inventors: Yasushi Yamanaka, Nakashima-gun (JP); Yasutaka Kuroda, Anjo (JP); Shin Nishida, Anjo (JP); Motohiro Yamaguchi, Hoi-gun (JP); Yukikatsu Ozaki, Nishio (JP); Tadashi Hotta, Nishio (JP); Sadahisa Onimaru, Chiryu (JP); Mitsuo Inagaki, Okazaki (JP)

(73) Assignees: DENSO Corporation, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 09/892,109

(22) Filed: Jun. 26, 2001

(65) Prior Publication Data

US 2001/0037653 A1 Nov. 8, 2001

Related U.S. Application Data

(62) Division of application No. 09/524,676, filed on Mar. 13, 2000, now Pat. No. 6,321,564.

(30) Foreign Application Priority Data

Mar. 15, 1999 (JP) ..... 11-68871
Dec. 14, 1999 (JP) ..... 11-354817

(51) Int. Cl.[7] ..... F28B 9/00; F25B 1/00
(52) U.S. Cl. ..... 62/172; 62/402
(58) Field of Search ..... 62/172, 116, 402, 62/DIG. 17

(56) References Cited

U.S. PATENT DOCUMENTS

| | | | | |
|---|---|---|---|---|
| 1,938,205 A | | 12/1933 | Yeomans | 62/116 X |
| 2,494,120 A | | 1/1950 | Ferro, Jr. | 62/116 X |
| 2,519,010 A | | 8/1950 | Zearfoss, Jr. | 62/116 |
| 3,277,658 A | | 10/1966 | Leonard, Jr. | 62/116 |
| 4,235,079 A | * | 11/1980 | Masser | 62/116 |
| 5,157,931 A | * | 10/1992 | Alsenz | 62/116 |
| 5,289,692 A | * | 3/1994 | Campbell et al. | 62/DIG. 17 |
| 5,819,554 A | * | 10/1998 | Glen | 62/498 |
| 6,044,655 A | * | 4/2000 | Ozaki et al. | 62/DIG. 17 |

* cited by examiner

*Primary Examiner*—William Wayner

(57) ABSTRACT

In a refrigerant cycle system, refrigerant compressed in a first compressor is cooled and condensed in a radiator, and refrigerant from the radiator branches into main-flow refrigerant and supplementary-flow refrigerant. The main-flow refrigerant is decompressed in an expansion unit while expansion energy of the main-flow refrigerant is converted to mechanical energy. Thus, the enthalpy of the main-flow refrigerant is reduced along an isentropic curve. Therefore, even when the pressure within the evaporator increases, refrigerating effect is prevented from being greatly reduced in the refrigerant cycle system. Further, refrigerant flowing into the radiator is compressed using the converted mechanical energy. Thus, coefficient of performance of the refrigerant cycle system is improved.

23 Claims, 18 Drawing Sheets

REFRIGERANT CYCLE SYSTEM WITH EXPANSION ENERGY RECOVERY

CROSS-REFERENCE TO RELATED APPLICATION

This is a division of U.S. patent application Ser. No. 09/524,676, filed Mar. 13, 2000, now U.S. Pat. No. 6,321, 564.

This application is related to and claims priority from Japanese Patent Applications No. Hei. 11-68871 filed on Mar. 15, 1999 and No. Hei. 11-354817 filed on Dec. 14, 1999, the contents of which are hereby incorporated by reference.

BACKGROUND OF THE INVENTION

1. Field of the Invention

The present invention relates to a vapor-compression type refrigerant cycle system in which expansion energy in an expansion unit is recovered. The present invention is suitably applied to a refrigerant cycle system in which refrigerant such as ethylene, ethane, nitrogen oxide, or carbon dioxide is used so that pressure of refrigerant discharged from a compressor exceeds critical pressure.

2. Description of Related Art

In a conventional vapor-compression type refrigerant cycle, after compressed refrigerant is cooled and is press-reduced, low-pressure refrigerant is evaporated in an evaporator so that refrigerating effect is obtained. However, in the conventional refrigerant cycle, the refrigerating effect is determined based on an enthalpy difference of refrigerant between an inlet side and an outlet side of the evaporator. Therefore, when temperature within the evaporator increases and pressure within the evaporator (i.e., pressure at a refrigerant inlet of the evaporator) increases, the enthalpy difference of refrigerant between the inlet side and the outlet side of the evaporator becomes smaller, and the refrigerating effect of the refrigerant cycle decreases.

SUMMARY OF THE INVENTION

In view of the foregoing problems, it is an object of the present invention to provide a refrigerant cycle system which prevents refrigerating effect from being greatly decreased even when pressure within an evaporator is increased.

According to an aspect of the present invention, a refrigerant cycle system includes a radiator for cooling a compressed refrigerant, an inner heat exchanger in which refrigerant from the radiator branches into first-flow refrigerant and second-flow refrigerant and the second-flow refrigerant is decompressed to perform a heat exchange between the first-flow refrigerant and the decompressed second-flow refrigerant, an expansion unit for decompressing and expanding the first-flow refrigerant having been heat-exchanged with the second-flow refrigerant, an expansion-energy recovering unit for converting expansion energy during a refrigerant expansion in the expansion unit to mechanical energy, and an evaporator for evaporating refrigerant from the expansion unit. The expansion-energy recovering unit is disposed to compress refrigerant flowing into the radiator using the mechanical energy. Thus, an enthalpy difference between a refrigerant inlet side and a refrigerant outlet side of the evaporator is increased by the conversion energy from the expansion energy to the mechanical energy. Therefore, even when the pressure within the evaporator increases, refrigerating effect is prevented from being greatly reduced. Further, because refrigerant flowing into the radiator is compressed using the converted mechanical energy, a compression operation amount is reduced in the while refrigerant cycle system, and coefficient of performance is improved relative to the compression operation amount.

According to an another aspect of the present invention, an expansion unit for decompressing and expanding refrigerant discharged from the radiator is disposed to recover expansion energy during a refrigerant expansion, and a control unit controls a relation amount relative to operation of the expansion unit to control a pressure of high-pressure side refrigerant having been compressed by the compressor and before being decompressed by the expansion unit. Because the refrigerant cycle system operates while the expansion energy is recovered, actual consumption power in the refrigerant cycle system is reduced, and coefficient of performance of the refrigerant cycle system is improved. Therefore, even when the compression operation amount of a compressor increases for preventing the refrigerating effect from reducing when temperature within the evaporator increases, actual consumption power of the compressor is prevented from increasing. Accordingly, even when the pressure within the evaporator increases, the refrigerant cycle system prevents the refrigerating effect from being greatly decreased.

For example, the relation amount relative to the operation of the expansion unit is an energy amount recovered during a refrigerant expansion of the expansion unit, is a refrigerant amount flowing through the expansion unit, or a driving force which is necessary for driving the expansion unit.

Preferably, the control unit controls the pressure of the high-pressure side refrigerant to become a target pressure determined based on a refrigerant temperature at a refrigerant outlet of the radiator. Therefore, the refrigerating effect is further improved in the refrigerant cycle system.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the accompanying drawings.

A first preferred embodiment of the present invention will be now described with reference to FIGS. 1–4. In the first embodiment, the present invention is applied to a supercritical refrigerant cycle for a vehicle in which carbon dioxide is used as refrigerant, for example.

Figure 1:
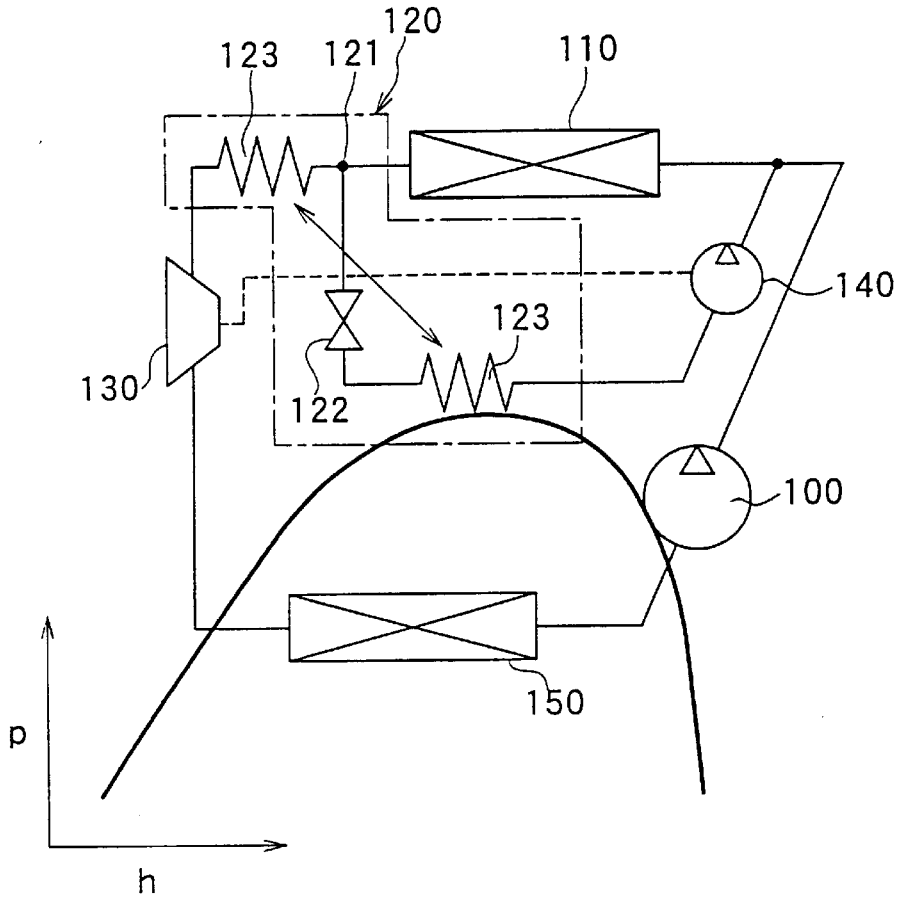
FIG. 1 is a schematic view showing a refrigerant cycle system on a mollier diagram (p-h)

In FIG. 1, a first compressor 100 for sucking and compressing refrigerant (e.g., carbon dioxide) is driven by a driving unit (not shown) such as a vehicle engine, and gas refrigerant discharged from the first compressor 100 is cooled in a radiator (i.e., gas cooler) 110. An inner heat-exchanging unit 120 indicated by the chain line in FIG. 1 includes a branching point 121 at which refrigerant from the radiator 110 branches into main-flow refrigerant directly flowing into a heat exchanger 123, and supplementary-flow refrigerant flowing into the heat exchanger 123 after passing through a throttle (pressure-reducing unit) 122. Therefore, in the heat exchanger 123, the main-flow refrigerant and the supplementary-flow refrigerant are heat exchanged.

The main-flow refrigerant cooled by the supplementary-flow refrigerant in the heat exchanger 123 is decompressed and expanded in an expansion unit 130. In a second compressor 140, expansion energy of the main-flow refrigerant expanded in the expansion unit 130 is converted into mechanical energy, and the supplementary-flow refrigerant from the heat exchanger 123 is compressed by using the converted mechanical energy. Therefore, the second compressor 140 is also used as an expansion-energy recovering unit. The compressed supplementary-flow refrigerant is discharged from the second compressor 140 to a refrigerant inlet side of the radiator 110.

On the other hand, refrigerant discharged from the expansion unit 130 is evaporated in an evaporator 150 to provide refrigerating effect. In the first embodiment, because carbon dioxide is used as refrigerant, the pressure of refrigerant discharged from the first compressor 100 is need to exceed the critical pressure of carbon dioxide for increasing the refrigerating effect.

Figure 2:
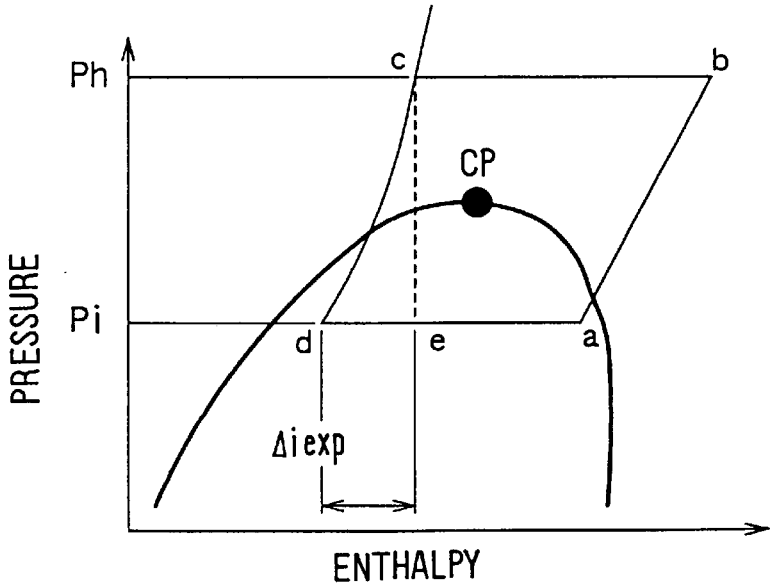
FIG. 2 is a mollier diagram of carbon dioxide according to the first embodiment.

According to the first embodiment of the present invention, the expansion unit 130 decompresses the main-flow refrigerant while the expansion energy of the main-flow refrigerant is converted into the mechanical energy. Therefore, enthalpy of the main-flow refrigerant flowing from the heat exchanger 123 is decreased while the phase of the main-flow refrigerant is transformed along the isentropic curve "c–d" in FIG. 2. In FIG. 2, the pressure of carbon dioxide is set so that Ph/Pi is 15/6 Mpa. Further, in FIG. 2, CP indicates the critical point of mollier diagram.

Figure 4:
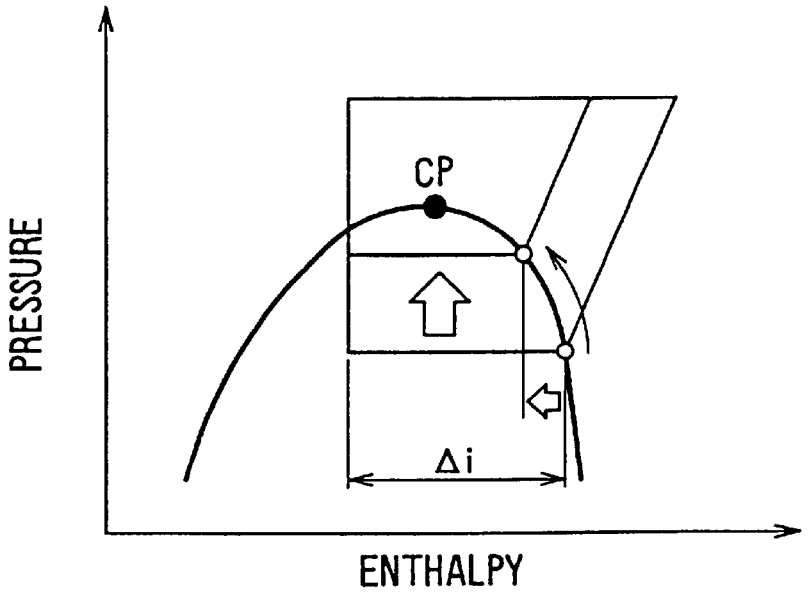
FIG. 4 is a mollier diagram of a comparison example of the first embodiment.

Thus, it is compared with a refrigerant cycle shown in FIG. 4 where an adiabatic expansion is simply performed during a decompression operation of refrigerant, an enthalpy difference of refrigerant between an inlet side and an outlet side of the evaporator 150 is increased by expansion operation Δiexp (expansion loss). Further, the second compressor 140 operates by the expansion operation Δiexp, a part of compression operation amount of the first compressor 100 is recovered in the refrigerant cycle system. Thus, in the whole refrigerant cycle system of the first embodiment, the compression operation amount is reduced, and coefficient of performance (COP) relative to the compression operation amount is improved. Accordingly, according to the first embodiment of the present invention, even when an inner pressure of the evaporator 150 is increased, the refrigerating effect is prevented from being greatly decreased, and coefficient of performance (COP) of the refrigerant cycle system is improved.

Further, because the main-flow refrigerant is cooled in the heat exchanger 123 by the supplementary-flow refrigerant having passed through the throttle 122, enthalpy of refrigerant at the inlet side of the evaporator 150 is decreased, and the enthalpy difference of refrigerant between the inlet side and the outlet side of the evaporator 150 is made larger. Thus, in the refrigerant cycle system of the first embodiment, the refrigerating effect is increased.

Figure 3:
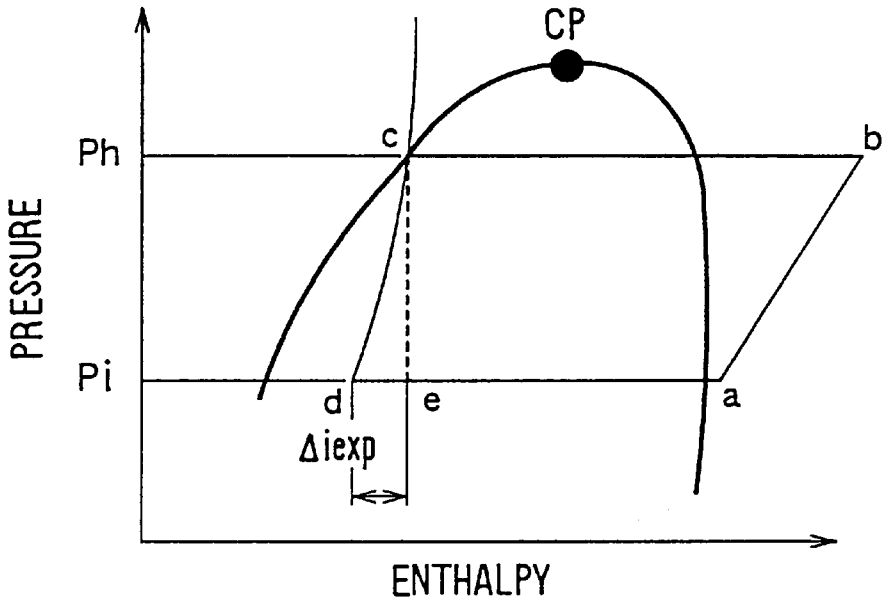
FIG. 3 is a mollier diagram of flon according to the first embodiment.

In the above-described first embodiment, the carbon dioxide is used as refrigerant. However, flon (HFC 134*a*) may be used as refrigerant. In this case, as shown in FIG. 3, enthalpy of the main-flow refrigerant flowing from the heat exchanger 123 is decreased while the phase of the main-flow refrigerant is transformed along the isentropic curve "c–d" in FIG. 3. In FIG. 3, the pressure of flon is set so that Ph/Pi is 22/0.6 Mpa. Even when flon is used as refrigerant circulating in the refrigerant cycle system, the coefficient of performance in the refrigerant cycle system is improved due to the expansion operation Δiexp.

In the above-described first embodiment, the supplementary-flow refrigerant is compressed in the second compressor 140 by using the converted mechanical energy, and is introduced into the radiator 110. However, the converted mechanical energy may be used for the first compressor 100, or the other components of the refrigerant cycle system.

Figure 5:
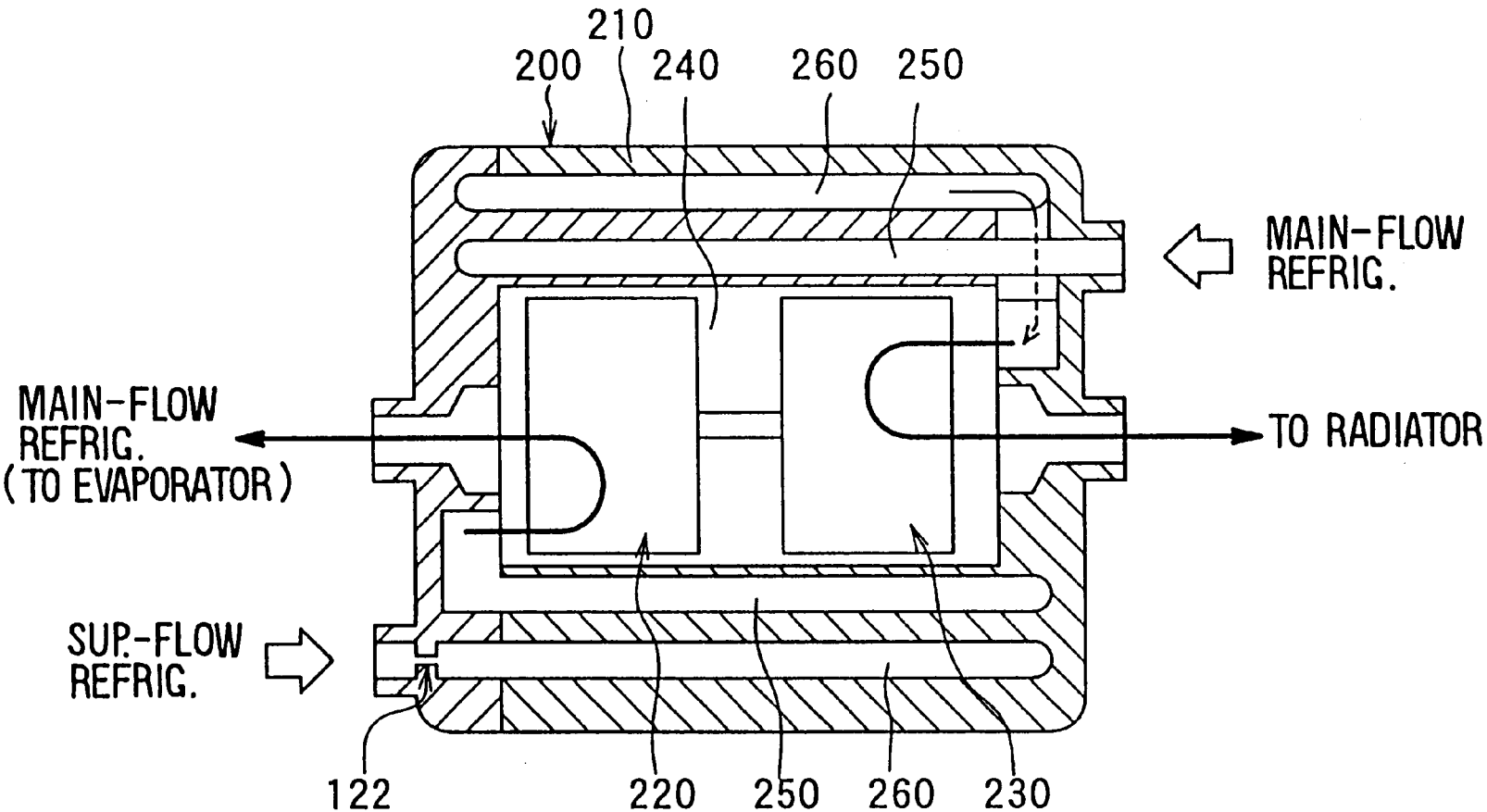
FIG. 5 is a schematic view showing an energy-recovering unit of a refrigerant cycle system according to a second preferred embodiment of the present invention.

A second preferred embodiment of the present invention will be now described with reference to FIG. 5. In the second embodiment, the inner heat-exchanging unit 120, the expansion unit 130 and the second compressor 140 described in the above-described first embodiment are integrated to form an integrated member so that the number of components in a refrigerant cycle system is decreased. In the second embodiment, the integrated member is indicated as an energy-recovering unit 200.

Next, the energy-recovering unit 200 is now described. As shown in FIG. 5, within an approximately cylindrical housing 210, a cylindrical mechanical chamber 240 is formed. A scroll-type energy conversion unit 220 for converting the expansion energy (heat energy) of refrigerant to the mechanical energy (rotation energy) and a scroll compression unit 230 are accommodated in the mechanical chamber 240. The scroll compression unit 230 are operated to compress the supplementary-flow refrigerant by the rotation energy obtained from the energy conversion unit 220.

The main-flow refrigerant flows into the energy conversion unit 220 through a main-flow passage 250 formed into a cylindrical shape around the mechanical chamber 240. On the other hand, the supplementary-flow refrigerant is sucked into the compression unit 230 through a supplementary-flow passage 260 which formed into a cylindrical shape outside the main-flow passage 250. Further, a flow direction of main-flow refrigerant in the main-flow passage 250 is set to be opposite to a flow direction of supplementary-flow refrigerant in the supplementary-flow passage 260, so that the main-flow refrigerant and the supplementary-flow refrigerant are heat-exchanged while passing through both the passages 250, 260.

Further, when the main-flow refrigerant flows into the energy conversion unit 220 from the main-flow passage 250, the pressure of the main-flow refrigerant is reduced while a scroll-type turbine (not shown) is rotated by the expansion energy (heat energy). Therefore, the main-flow refrigerant within the energy conversion unit 220 is changed along the isentropic curve. Further, as shown in FIG. 2, the main-flow refrigerant having been phase-changed in the energy conversion unit 220 is introduced into the evaporator 150 (see FIG. 1), and the supplementary-flow refrigerant from the compression unit 230 is introduced into the radiator 110 (see FIG. 1). In the second embodiment, the other portions are similar to those in the above-described first embodiment.

Figure 6:
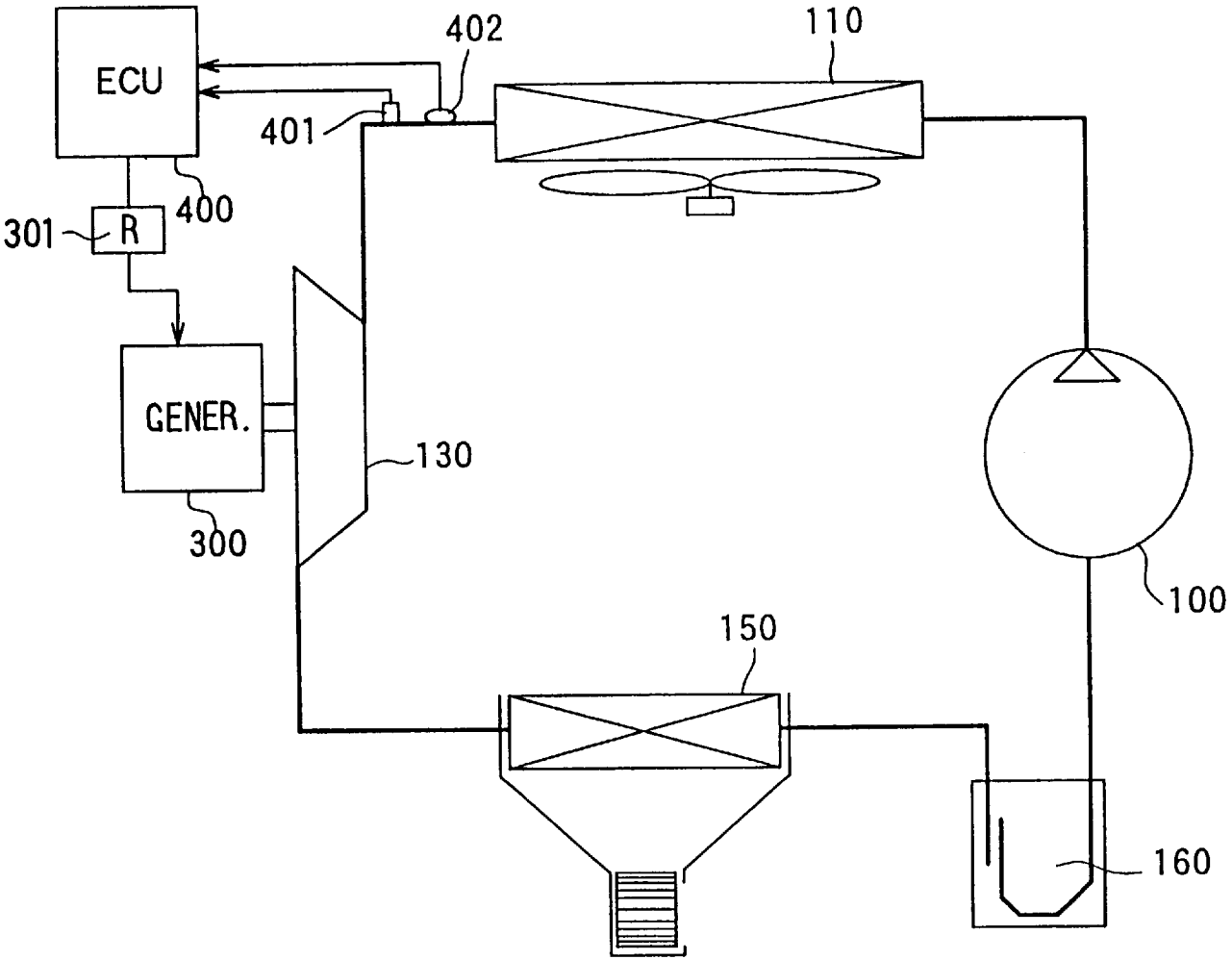
FIG. 6 is a schematic view of a refrigerant cycle system according to a third preferred embodiment of the present invention.
Figure 7:
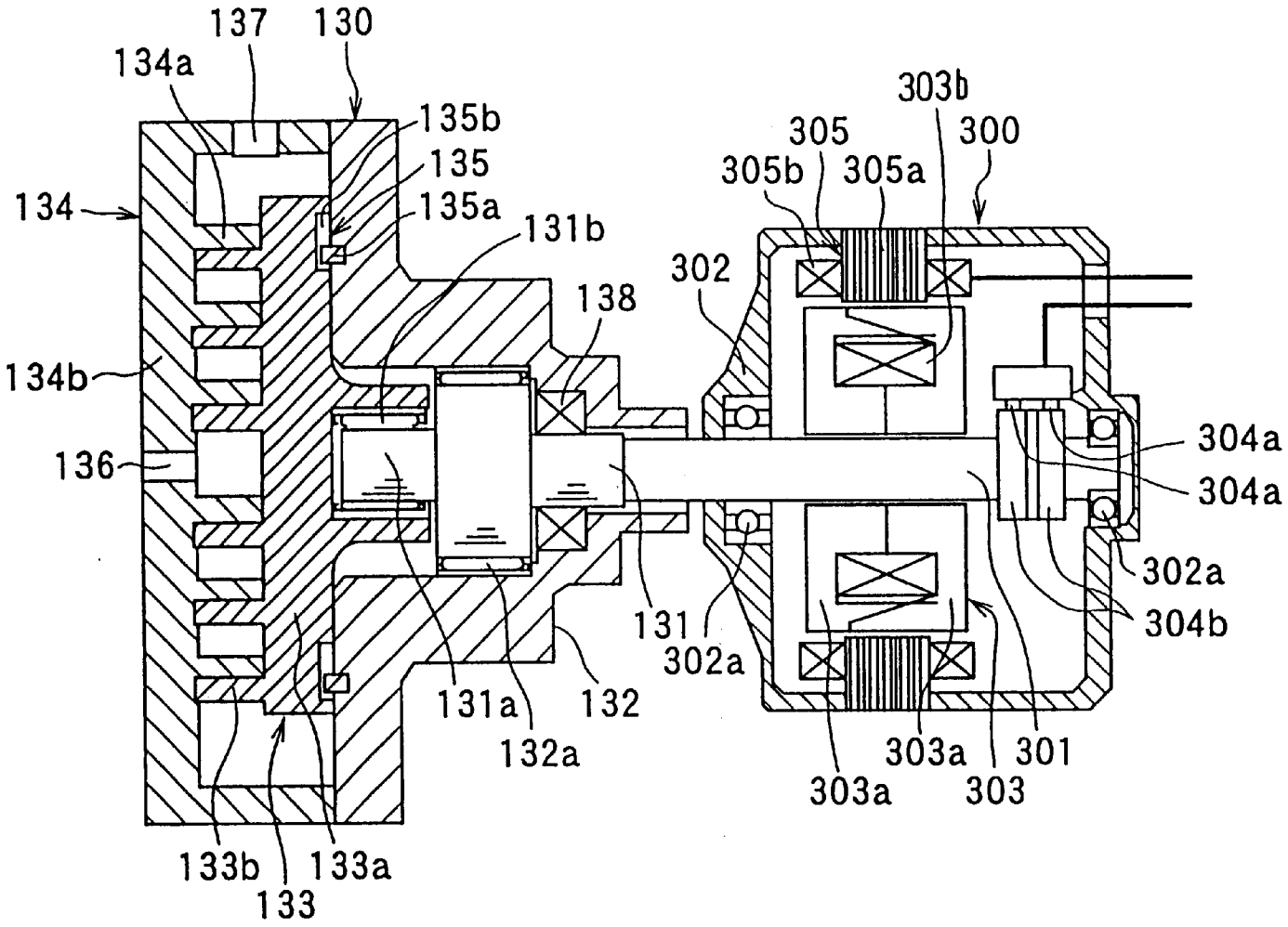
FIG. 7 is a sectional view showing an integrated structure of an expansion unit and a generator according to the third embodiment.

A third preferred embodiment of the present invention will be described with reference to FIGS. 6–10. In the above-described first and second embodiments of the present invention, refrigerant from the radiator 110 branches into the main-flow refrigerant and the supplementary-flow refrigerant. However, in the third embodiment, as shown in FIG. 6, refrigerant flowing from the radiator 110 does not branch. Specifically, refrigerant from the radiator 110 flows into the expansion valve 130 so that the expansion energy of refrigerant is converted to the mechanical energy (rotation energy) to be recovered. The recovered mechanical energy is supplied to a generator 300 to generate electrical power. In the third embodiment, the expansion unit 130 is a scroll type as shown in FIG. 7. FIG. 7 shows an integrated structure of the expansion unit 130 and the generator 300. As shown in FIG. 7, a rotation shaft 131 of the expansion unit 130 is directly connected to a rotor shaft 301 of the generator 300.

In the third embodiment and the following embodiments of the present invention, because the first compressor 100 driven by the vehicle engine is only used, the first compressor 100 is referred to as "a compressor 100".

Refrigerant flowing from the evaporator 150 is separated in an accumulator (i.e., gas-liquid separating unit) 160 into gas refrigerant and liquid refrigerant. Gas refrigerant separated in the accumulator 160 flows into the compressor 100, and liquid refrigerant is stored in the accumulator 160 as a surplus refrigerant within the refrigerant cycle system.

Electrical voltage (exciting current) applied to the generator 300 is controlled by an electronic control unit (ECU) 400 which controls the operation of the expansion unit 130. Signals from a pressure sensor (i.e., pressure detecting unit) 401 for detecting pressure of refrigerant at the outlet side of the radiator 110 and from a temperature sensor (i.e., temperature detecting unit) 402 for detecting temperature of refrigerant at the outlet side of the radiator 110 are input into the ECU 400. The ECU 400 controls the electrical voltage applied to the generator 303 based on the input signals from the sensors 401, 402 in accordance with a pre-set program.

Here, an integrated schematic structure of the expansion unit 130 and the generator 300 will be now described. The expansion unit 130 includes a housing 132. The rotation shaft 131 is rotatably held in the housing 132 through a bearing 132*a*. A crank portion 131*a* is formed in the rotation shaft 131 at a longitudinal end opposite to the generator 300 to be offset from a rotation center axis. A movable scroll 133 is rotatably assembled to the crank portion 131*a* of the rotation shaft 131 through a bearing 131*b*. The movable scroll 133 includes an approximately circular end plate portion 133*a*, and a scroll lap portion 133*b* protruding from the end plate portion 133*a* to a side opposite to the rotation shaft 131.

A stable scroll 134 includes a scroll lap portion 134*a* engaged with the scroll lap portion 133*b* of the movable scroll 133, and an end plate portion 134*b*. The end plate portion 134*b* of the stable scroll 134 and the housing 132 define a space where the movable scroll 133 is rotated. The stable scroll 134 and the housing 132 are air-tightly connected by a fastening unit such as a bolt (not shown).

A rotation of the movable scroll 133 around the crank portion 131*a* is prevented by a rotation prevention member 135. In the third embodiment, the rotation prevention member 135 is constructed by a pin 135*a* and a recess portion 135*b*.

Refrigerant from the radiator 110 flows into the expansion unit 130 from a refrigerant inlet 136. Refrigerant is introduced from the refrigerant inlet 136 into an operation chamber defined by the movable and stable scrolls 133, 134. At this time, because the movable scroll 133 is rotated so that the volume of the operation chamber becomes larger due to the refrigerant pressure within the operation chamber, expansion energy of high-pressure refrigerant in the operation chamber is converted into rotation energy (mechanical energy) for rotating the rotation shaft 131 and the movable scroll 133. Further, the volume of the operation chamber increases while a scroll center moves to an outer side. Therefore, refrigerant moved to a scroll outer side within the operation chamber is decompressed, and the decompressed refrigerant flows from a refrigerant outlet 137 provided in the stable scroll 134 toward the evaporator 150. Refrigerant and lubrication oil within the housing 132 is prevented from being leaked from a clearance between the housing 132 and the rotation shaft 131 by a shaft seal member attached between the housing 132 and the rotation shaft 131.

On the other hand, the generator 300 includes a housing 302. The rotor shaft 301 is disposed in the housing 302 to be rotatable through a bearing 302*a*. A rotor 303 integrally rotated with the rotor shaft 301 includes a pair of rotor cores

303*a* made of ferromagnetic material, and a rotor coil 303*b* inserted between the rotor cores 303*a*.

Exciting electrical current is supplied to the rotor coil 303*b* of the rotor 303 through a brush 304*a* and a slip ring 304*b*. In the third embodiment, exciting electrical current is controlled, so that electrical power generated in the generator 300 is controlled and the pressure of high-pressure side refrigerant in the refrigerant cycle system is controlled. Here, the high-pressure side refrigerant is the refrigerant between a discharge side of the compressor 100 and an inlet side of a decompressing unit such as the expansion unit 130. Therefore, in the third embodiment, refrigerant at the outlet side of the radiator 110 is the high-pressure side refrigerant.

A stator 305 is fixed to the housing 302. The stator 305 includes a stator core 305*a* made of a ferromagnetic material, and a stator coil wound around the stator core 305*a*. Since the rotor 303 rotates in an excited state, induced electromotive force induced in the stator coil 305*b* of the stator 305 is output as the generated electrical power.

Figure 8:
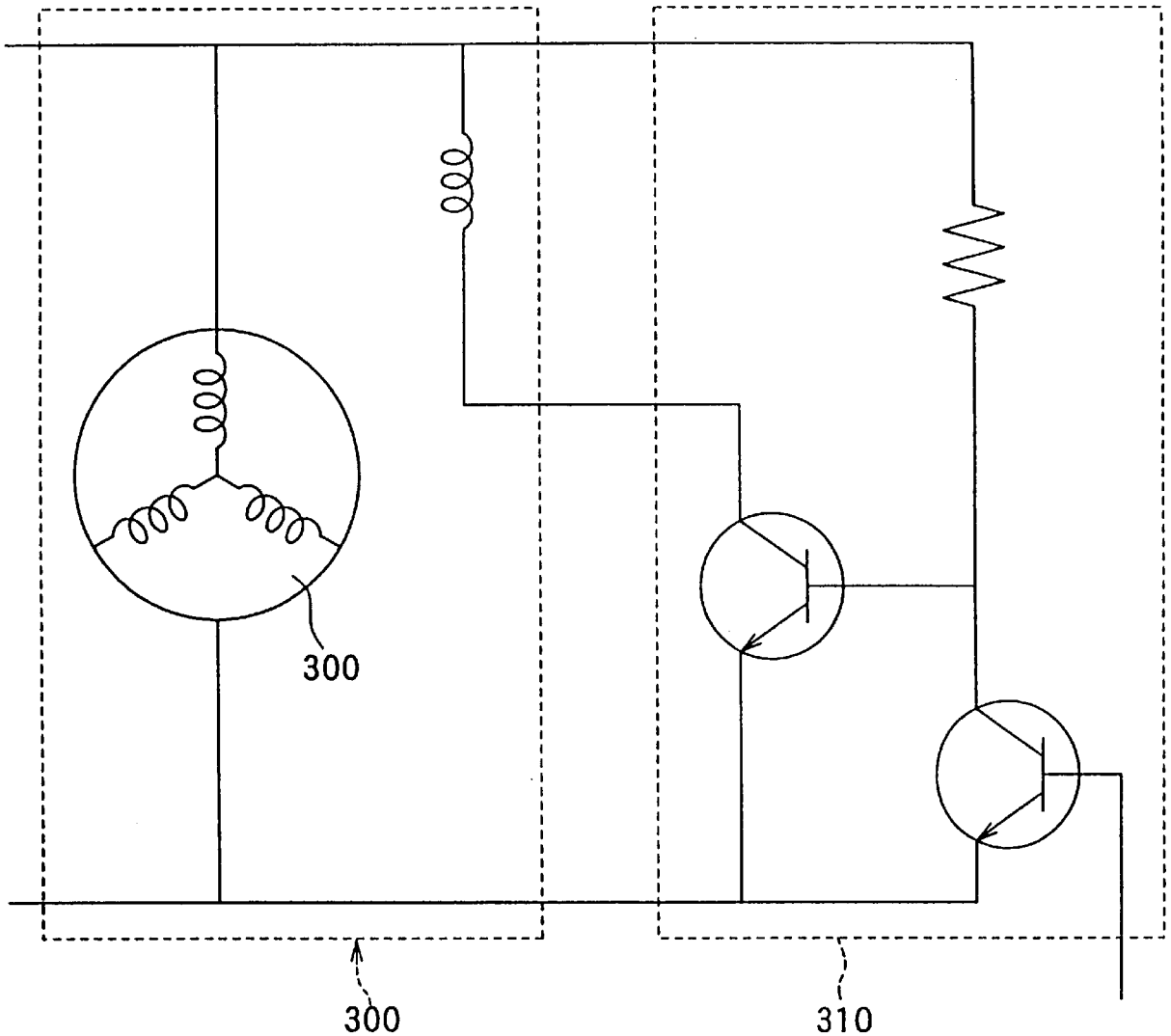
FIG. 8 is a control circuit of the generator according to the third embodiment.

FIG. 8 shows a control circuit 310 of the generator 300 according to the third embodiment. An exciting current is applied to the rotor coil 303*b* in the control circuit 310, after the control circuit 310 receives the exciting current control signal from the ECU 400.

Figure 9:
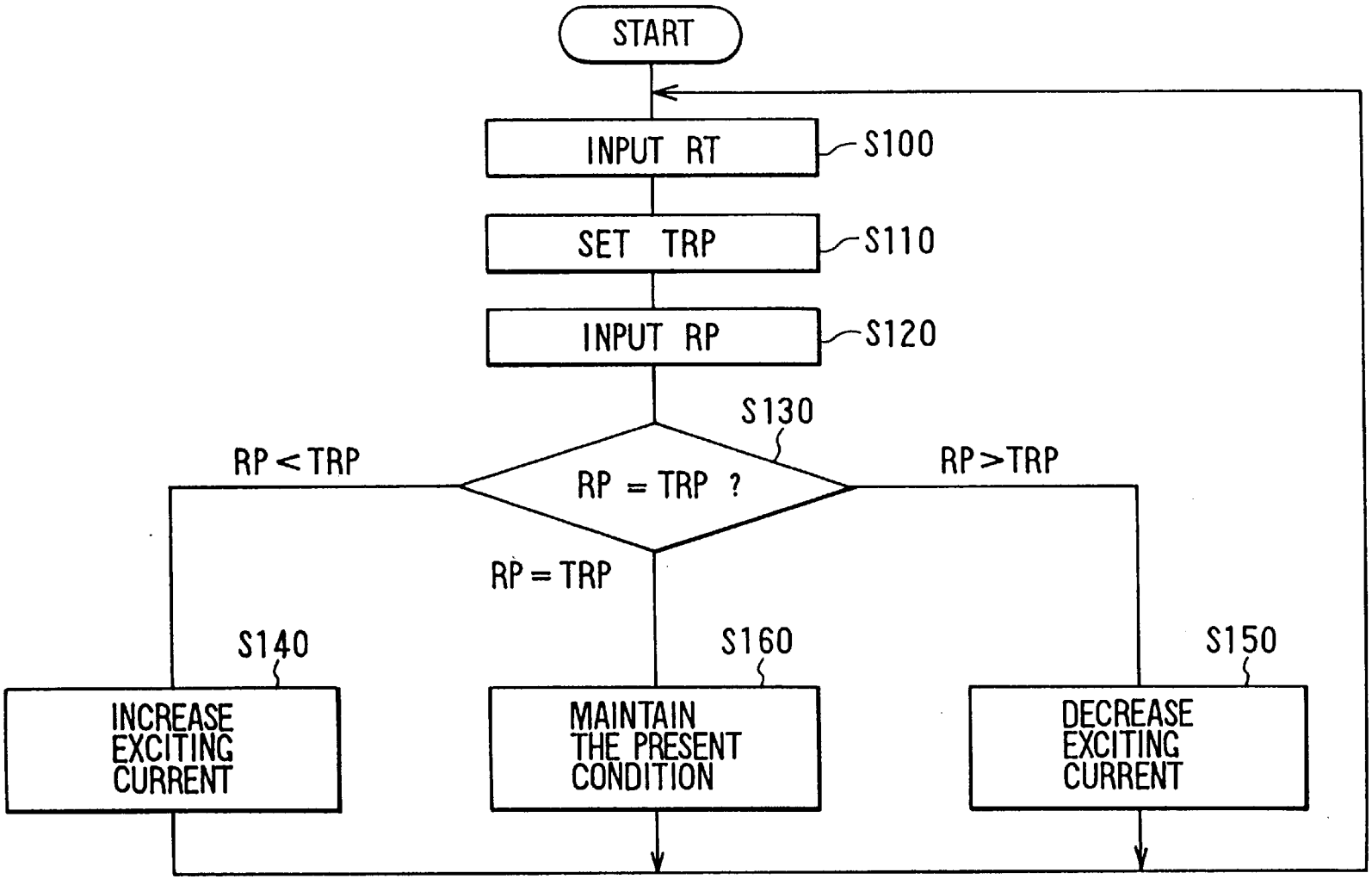
FIG. 9 is a flow diagram showing a control operation of the refrigerant cycle system according to the third embodiment.

Next, operation and characteristics of the refrigerant cycle system according to the third embodiment will be now described. FIG. 9 shows a control program of the ECU 400. When a start switch (not shown) of a refrigerant cycle system is turned on, a refrigerant temperature RT at the outlet side of the radiator 110, detected by the temperature sensor 402, is input into the ECU 400, at step S100. Next, at step S110, a target refrigerant pressure TRP at the outlet side of the radiator 110 is calculated based on the refrigerant temperature RT detected by the temperature sensor 402.

Figure 10:
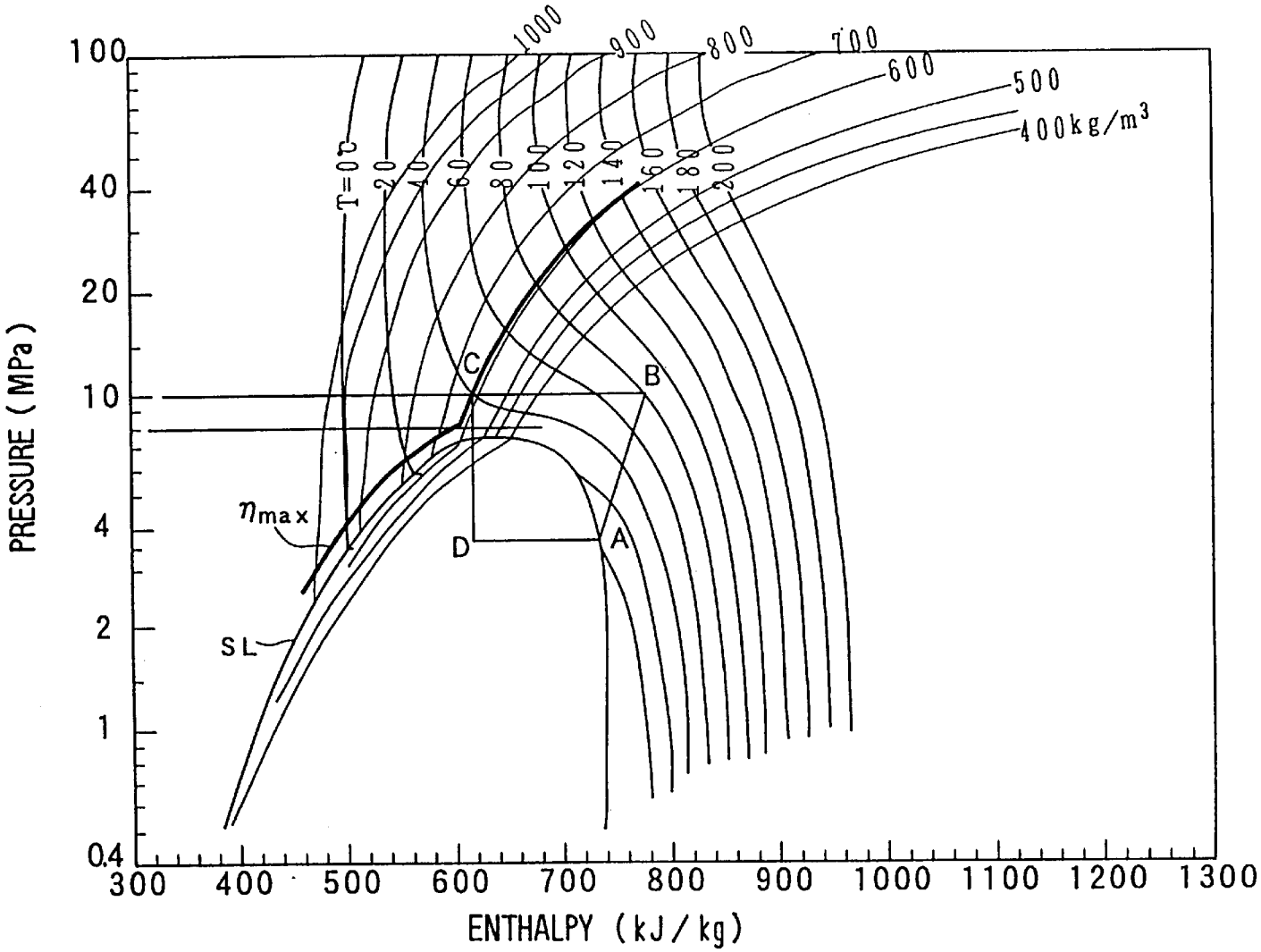
FIG. 10 is a mollier diagram of carbon dioxide according to the third embodiment.

The target refrigerant pressure TRP is determined based on the relationship between the refrigerant pressure and the refrigerant temperature, indicated by the suitable control line $\eta max$ in FIG. 10. In FIG. 10, the suitable control line $\eta max$ shows the relationship between the refrigerant temperature at the outlet side of the radiator 110 and a refrigerant pressure at the outlet side of the radiator 110, where the coefficient of performance becomes maximum in the refrigerant cycle system.

Next, at step 120 in FIG. 9, a refrigerant pressure RP at the outlet side of the radiator 110 is detected by the pressure sensor 401, and is input into the ECU 400. Next, at step S130, it is determined whether or not the refrigerant pressure RP at the outlet of the radiator 110 is equal to the target refrigerant pressure TRP. When the refrigerant pressure RP is different from the target refrigerant pressure TRP, the exciting current is controlled so that the refrigerant pressure RP at the outlet side of the radiator 110 becomes equal to the target refrigerant pressure TRP.

Specifically, when the refrigerant pressure RP at the outlet side of the radiator 110 is smaller than the target refrigerant pressure TRP at step S130, the exciting current supplied to the rotor coil 303*b* of the rotor 303 is increased at step S140 so that magnetic force induced in the rotor 303 is increased. Therefore, electrical power generated from the stator coil 305*b* is increased. Thus, a necessary driving force for rotating and driving the generator 300 (rotor 303), that is, a necessary driving force for driving the expansion unit 130 is increased. Accordingly, load applied to the compressor 100 becomes larger, the pressure of high-pressure side refrigerant (i.e., the refrigerant pressure at the outlet side of the radiator 110) is increased, and the refrigerant amount flowing into the expansion unit 130 is decreased.

On the other hand, when refrigerant pressure RP at the outlet side of the radiator 110 is larger than the target refrigerant pressure TRP at step S130 in FIG. 9, the exciting current supplied to the rotor coil 303*b* of the rotor 303 is decreased at step S150 so that magnetic force induced in the rotor 303 is decreased. Therefore, electrical power generated from the stator coil 305*b* is decreased. Thus, a necessary driving force for rotating and driving the generator 300 (rotor 303), that is, a necessary driving force for driving the expansion unit 130 is decreased. Accordingly, load applied to the compressor 100 becomes smaller, the pressure of high-pressure side refrigerant (i.e., the refrigerant pressure at the outlet side of the radiator 110) is decreased, and the refrigerant amount flowing into the expansion unit 130 is increased.

Further, when refrigerant pressure RP at the outlet side of the radiator 110 is equal to the target refrigerant pressure TRP at step S130, the present condition is maintained at step S160. That is, at step S160, the present exciting current supplied to the rotor coil 303*b* of the rotor 303 is maintained.

As described above, in the third embodiment of the present invention, among the power supplying to the compressor 100, the expanding energy generated during a refrigerant decompression is recovered while the refrigerant cycle system operates. Therefore, an actual consumption power consumed in the refrigerant cycle system is reduced.

Thus, actual coefficient of performance is improved in the refrigerant cycle system. Therefore, even when the operation amount of the compressor 100 is increased for preventing the refrigerating effect from decreasing when the refrigerant temperature within the evaporator is increased, the actual consumption power of the compressor 100 is prevented from increasing. Accordingly, even when the refrigerant pressure within the evaporator 150 increases, the refrigerating effect is prevented from greatly being decreased.

Figure 11:
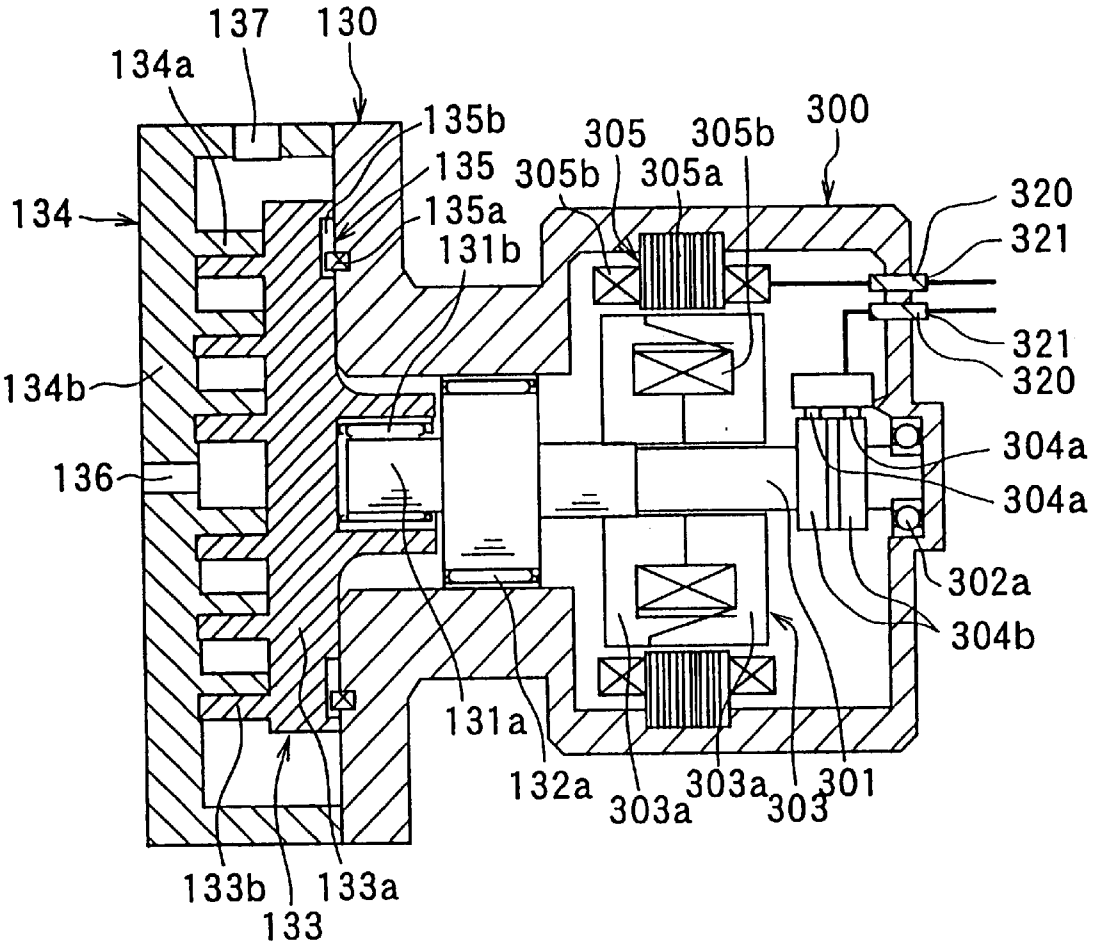
FIG. 11 is a sectional view showing an integrated structure of an expansion unit and a generator according to a fourth preferred embodiment of the present invention.

A fourth preferred embodiment of the present invention will be now described with reference to FIG. 11. In the above-described third embodiment, only the shaft 131 of the expansion unit 130 and the shaft 301 of the generator 300 are directly connected, while the housing 132 of the expansion unit 130 and the housing 302 of the generator 300 are separately formed. In the fourth embodiment of the present invention, as shown in FIG. 11, both the housings 131, 301 of the expansion unit 130 and the generator 301 are integrally formed.

In the fourth embodiment, because the housings 131, 302 of the expansion unit 130 and the generator 301 are integrated, a check seal 321 for air-tightly sealing the housing 302 is attached at electrical terminals 320 of the generator 300. Therefore, in the fourth embodiment, the seal member 138 contacting the shaft 131 described in the third embodiment is unnecessary. Thus, friction loss on the shaft 131 is reduced, and refrigerant leakage from the expansion unit 130 is prevented. In the fourth embodiment, the other portions are similar to those in the above-described third embodiment, and the explanation thereof is omitted.

Figure 12:
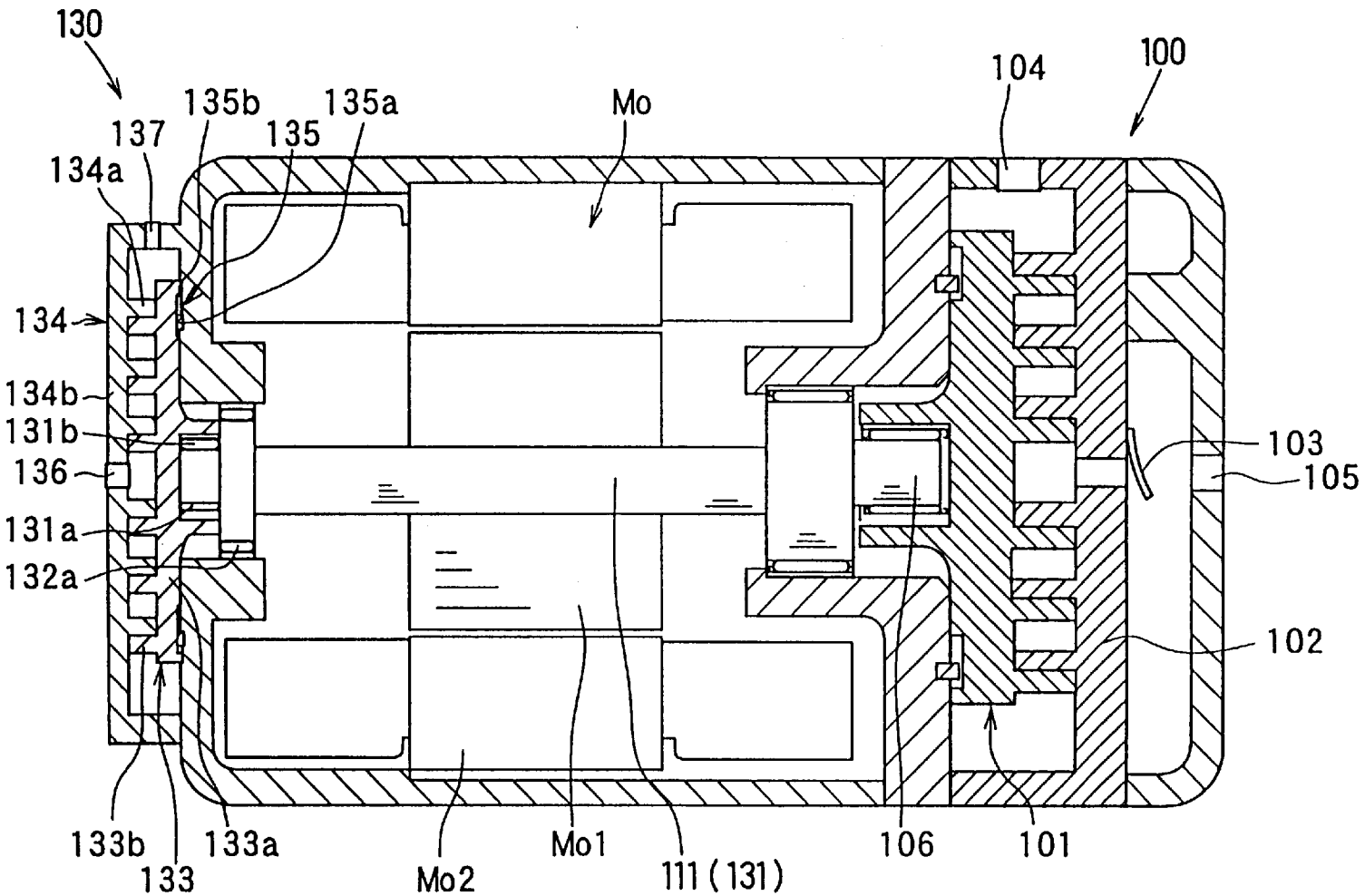
FIG. 12 is a sectional view showing an integrated structure of an expansion unit and a compressor according to a fifth preferred embodiment of the present invention.
Figure 13:
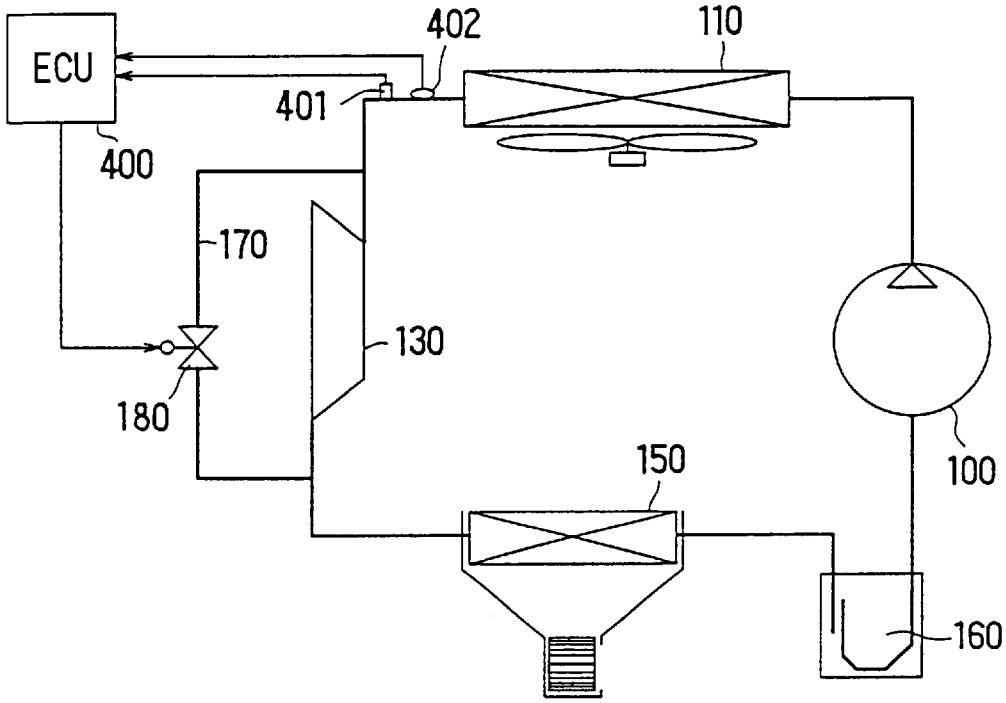
FIG. 13 is a schematic view of a refrigerant cycle system according to the fifth embodiment.

A fifth preferred embodiment of the present invention will be now described with reference to FIGS. 12–14. In the fifth embodiment, as shown in FIG. 12, the expansion unit 130 and the compressor 100 are integrated so that the mechanical energy recovered in the expansion unit 130 is directly supplied to the compressor 100. Further, as shown in FIG. 13, in a refrigerant cycle system of the fifth embodiment, a bypass refrigerant passage 170 through which refrigerant flowing from the radiator 110 is directly introduced into the evaporator 150 while bypassing the expansion unit 130 is provided, and an electrical control valve (throttle member) 180 is disposed in the bypass refrigerant passage 170. An integrated structure of the expansion unit 130 and the compressor 100 (hereinafter, referred to as "expansion unit-integrated compressor" will be described later in detail. In FIG. 13, the expansion unit 130 and the compressor 100 are indicated separately. However, actually, the expansion unit 130 and the compressor 100 are integrated as shown in FIG. 12.

In the expansion unit-integrated compressor of the fifth embodiment, because the expansion unit 130 and the compressor 100 are rotated with the same rotation speed, the refrigerant pressure at the outlet side of the radiator 110 is not controlled by controlling the expansion unit 130. Therefore, in the fifth embodiment, by controlling an opening degree of the control valve 180 by the ECU 400, the refrigerant pressure at the outlet side of the radiator 110 is controlled so that the relationship between the refrigerant temperature and the refrigerant pressure becomes the suitable relationship indicated by the suitable control line ηmax in FIG. 10.

Next, control operation of the control valve 180 will be now described with reference to FIG. 14. When a start switch (not shown) of the refrigerant cycle system is turned on, the refrigerant temperature RT at the outlet side of the radiator 110, detected by the temperature sensor 402, is input into the ECU 400, at step S200. Next, at step S210, a target refrigerant pressure TRP at the outlet side of the radiator 110 is calculated based on the refrigerant temperature RT detected by the temperature sensor 402. The target refrigerant pressure TRP is determined based on the relationship between the refrigerant pressure and the refrigerant temperature, indicated by the suitable control line ηmax in FIG. 10.

Figure 14:
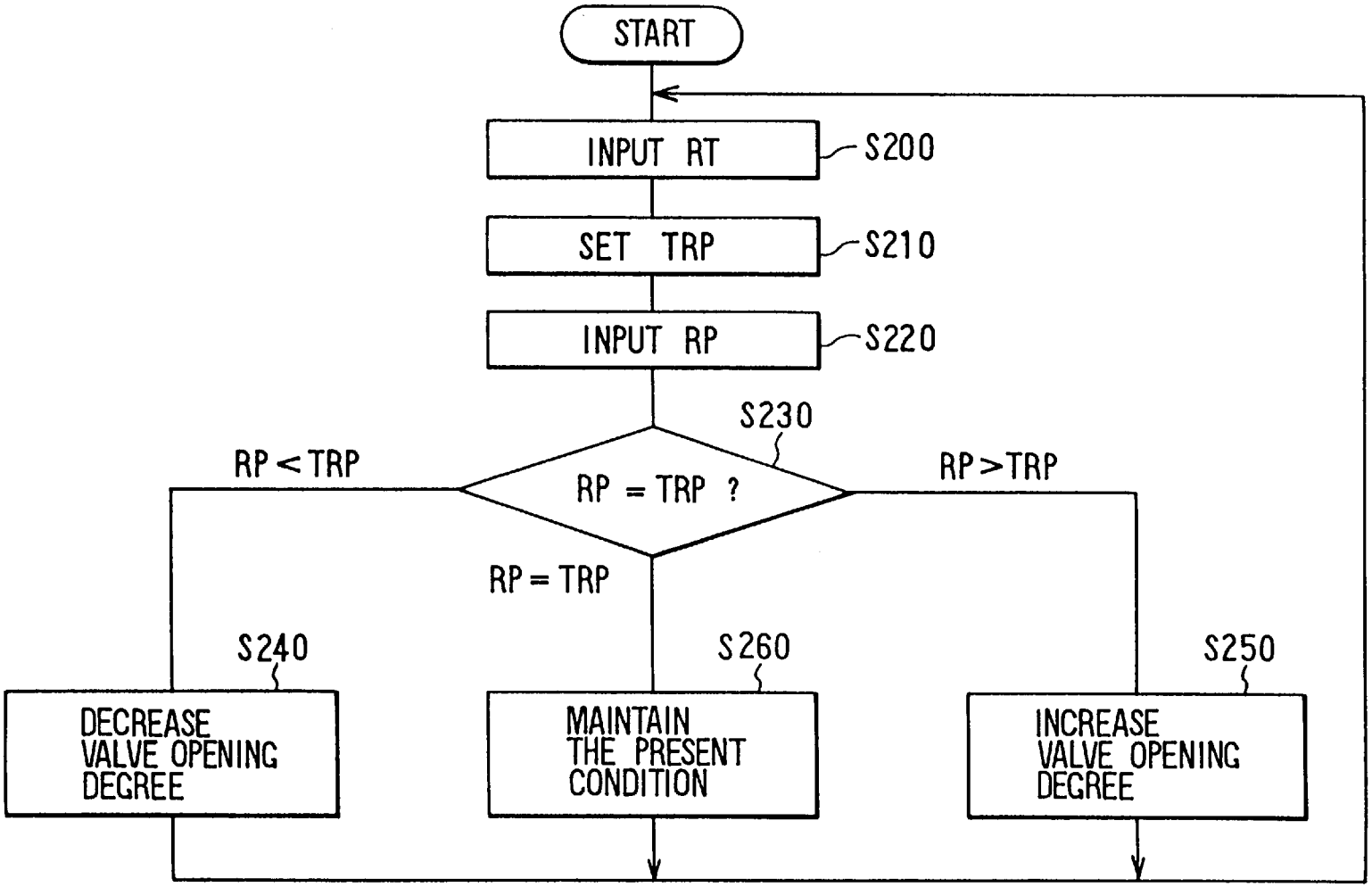
FIG. 14 is a flow diagram showing a control operation of the refrigerant cycle system according to the fifth embodiment.

Next, at step 220 in FIG. 14, a refrigerant pressure RP at the outlet side of the radiator 110 is detected by the pressure sensor 401, and is input into the ECU 400. Next, at step S230, it is determined whether or not the refrigerant pressure RP at the outlet of the radiator 110 is equal to the target refrigerant pressure TRP. When the refrigerant pressure RP is different from the target refrigerant pressure TRP, the opening degree of the control valve 180 is controlled so that the refrigerant pressure RP at the outlet side of the radiator 110 becomes equal to the target refrigerant pressure TRP.

Specifically, when the refrigerant pressure RP at the outlet side of the radiator 110 is smaller than the target refrigerant pressure TRP at step S230, the opening degree of the control valve 180 is reduced at step S240 so that the pressure of high-pressure side refrigerant (i.e., the refrigerant pressure at the outlet side of the radiator 110) is increased.

On the other hand, when refrigerant pressure RP at the outlet side of the radiator 110 is larger than the target refrigerant pressure TRP at step S230, the opening degree of the control valve 180 is increased at step S250 so that the pressure of high-pressure side refrigerant (i.e., the refrigerant pressure at the outlet side of the radiator 110) is decreased. Further, when refrigerant pressure RP at the outlet side of the radiator 110 is equal to the target refrigerant pressure TRP at step S230, the present condition is maintained at step S260. That is, at step S260, the present opening degree of the control valve 18 is maintained.

Next, the structure of the expansion unit-integrated compressor will be now described with reference to FIG. 12. In the expansion unit-integrated compressor of the fifth embodiment, the scroll type compressor 100, an electrical motor Mo for driving the compressor 100 and the expansion unit 130 are integrated. As shown in FIG. 12, the shaft of the compressor 100, the shaft of the electrical motor Mo and the shaft 131 of the expansion unit 130 are constructed by a single shaft 111. Because the expansion unit 130 and the compressor 100 (electrical motor Mo) are mechanically connected, the rotation speed of the expansion unit 130 becomes equal to that of the compressor 100. Therefore, it is impossible to independently control only the expansion unit 130. On the other hand, in the fifth embodiment, rotation energy generated in the electrical motor Mo and the mechanical energy recovered in the expansion unit 130 are supplied to the compressor 100.

The compressor 100 is a scroll type including a movable scroll 101 and a stable scroll 102. A discharging valve 103 is disposed so that discharged refrigerant is prevented from reversely flowing into an operation chamber defined by the movable scroll 101 and the stable scroll 102. Gas refrigerant from the accumulator 160 is sucked from a suction port 104 to be compressed, and compressed gas refrigerant is discharged to the radiator 110 from a discharge port 105. A crank portion 106 is disposed at a position offset from a rotation center of the shaft 111 to rotate the movable scroll 101.

Further, the expansion unit 130 is also a scroll type similarly to the above-described third embodiment. Further, the electrical motor Mo is a DC flange-less motor including a rotatable rotor motor Mo1 and a stator Mo2 fixed relative to a housing of the expansion unit-integrated compressor.

Thus, according to the fifth embodiment of the present invention, the coefficient of performance of the refrigerant cycle system is improved in the refrigerant cycle system because the mechanical energy recovered from the expansion unit 130 is used for the compression operation of the compressor 100.

Figure 15:
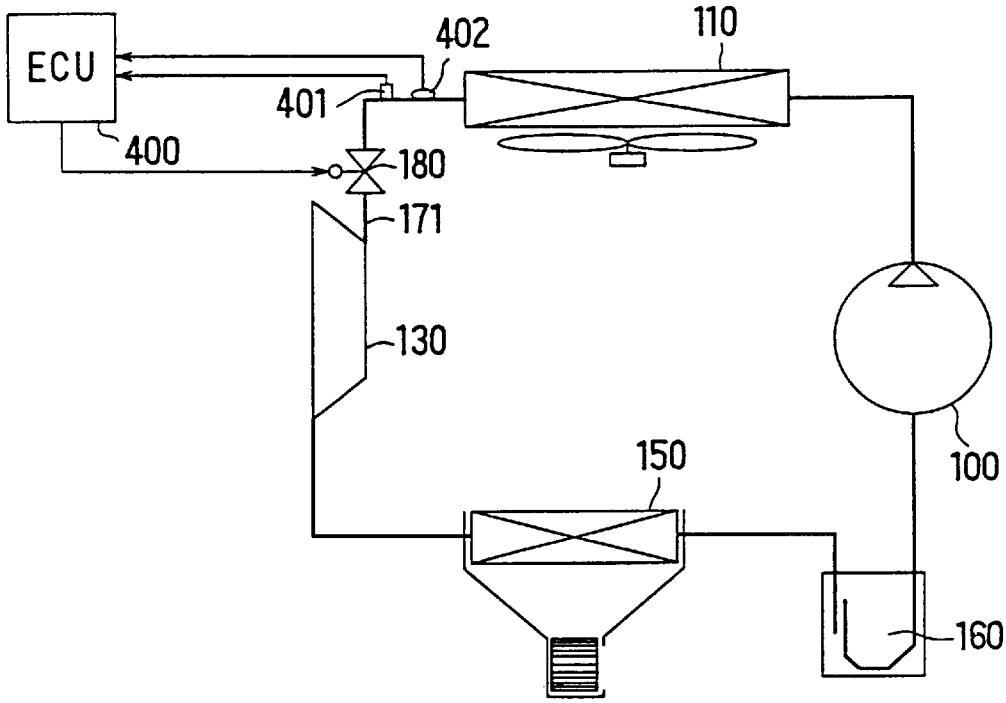
FIG. 15 is a schematic view of a refrigerant cycle system according to a sixth preferred embodiment of the present invention.

A sixth preferred embodiment of the present invention will be now described with reference to FIG. 15. The sixth embodiment is a modification of the above-described fifth embodiment. In the above-described fifth embodiment, the control valve 180 is disposed in the refrigerant bypass passage 170 through which refrigerant from the radiator 110 bypasses the expansion unit 130. However, in the sixth embodiment, the refrigerant bypass passage 170 is not provided, but the control valve 180 is disposed in a refrigerant passage 171 between the radiator 110 and the expansion unit 130. In FIG. 15, the expansion unit 130 and the compressor 100 are separately indicated. However, similarly to the fifth embodiment, both the expansion unit 130 and the compressor 100 are integrated. Further, the operation of the control valve 180 is controlled similarly to the control method described in the fifth embodiment.

Figure 16:
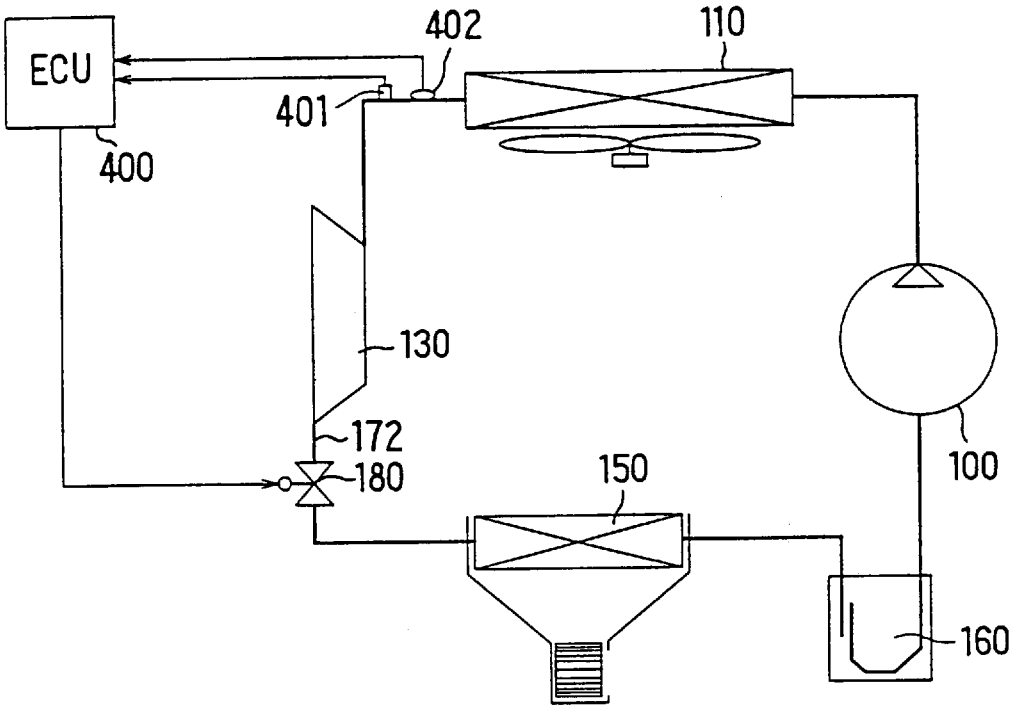
FIG. 16 is a schematic view of a refrigerant cycle system according to a seventh preferred embodiment of the present invention.

A seventh preferred embodiment of the present invention will be now described with reference to FIG. 16. The seventh embodiment is a modification of the above-described fifth embodiment. In the above-described fifth embodiment, the control valve 180 is disposed in the refrigerant bypass passage 170 through which refrigerant from the radiator 110 bypasses the expansion unit 130. However, in the seventh embodiment, the refrigerant bypass passage 170 is not provided, but the control valve 180 is disposed in a refrigerant passage 172 between the expansion unit 130 and the evaporator 150. In FIG. 16, the expansion unit 130 and the compressor 100 are separately indicated. However, similarly to the above-described fifth embodiment, both the expansion unit 130 and the compressor 100 are integrated. Further, the operation of the control valve 180 is controlled similarly to the control method described in the above-described fifth embodiment.

Figure 17:
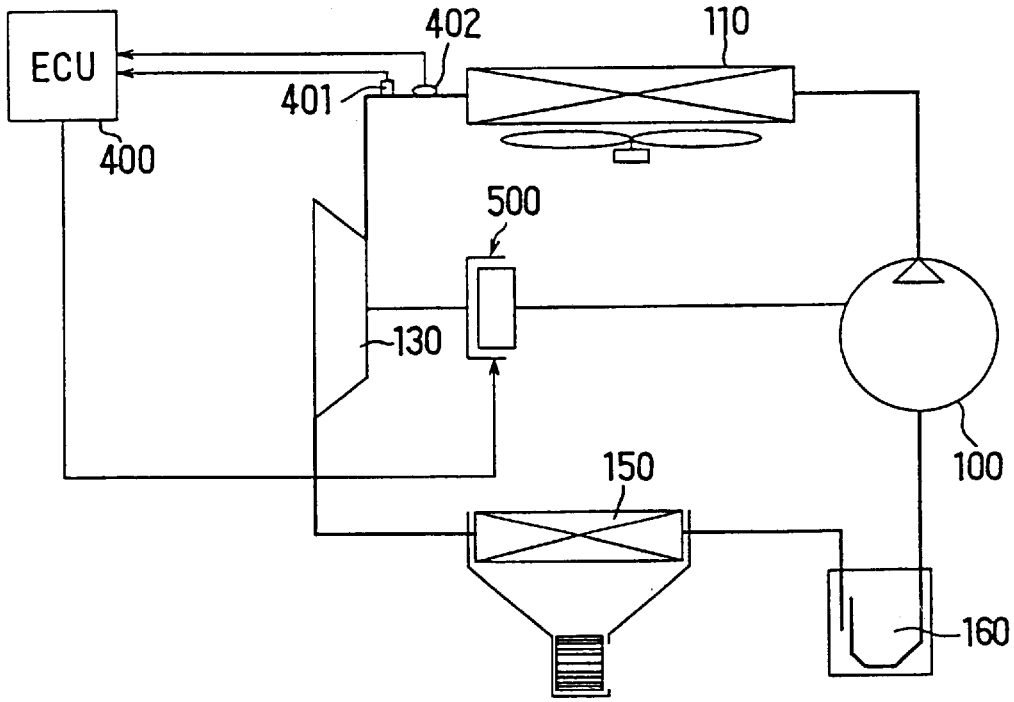
FIG. 17 is a schematic view of a refrigerant cycle system according to an eighth preferred embodiment of the present invention.

An eighth preferred embodiment of the present invention will be now described with reference to FIGS. 17 and 18. In the above-described fifth through seventh embodiments, the expansion unit 130 and the compressor 100 are integrated, and the refrigerant pressure at the outlet side of the radiator 110 is controlled by the control valve 180. However, in the eighth embodiment, the refrigerant pressure at the outlet of the radiator 110 is controlled without using the control valve 18 in the integrated structure of the expansion unit 130 and the compressor 100.

Figure 18:
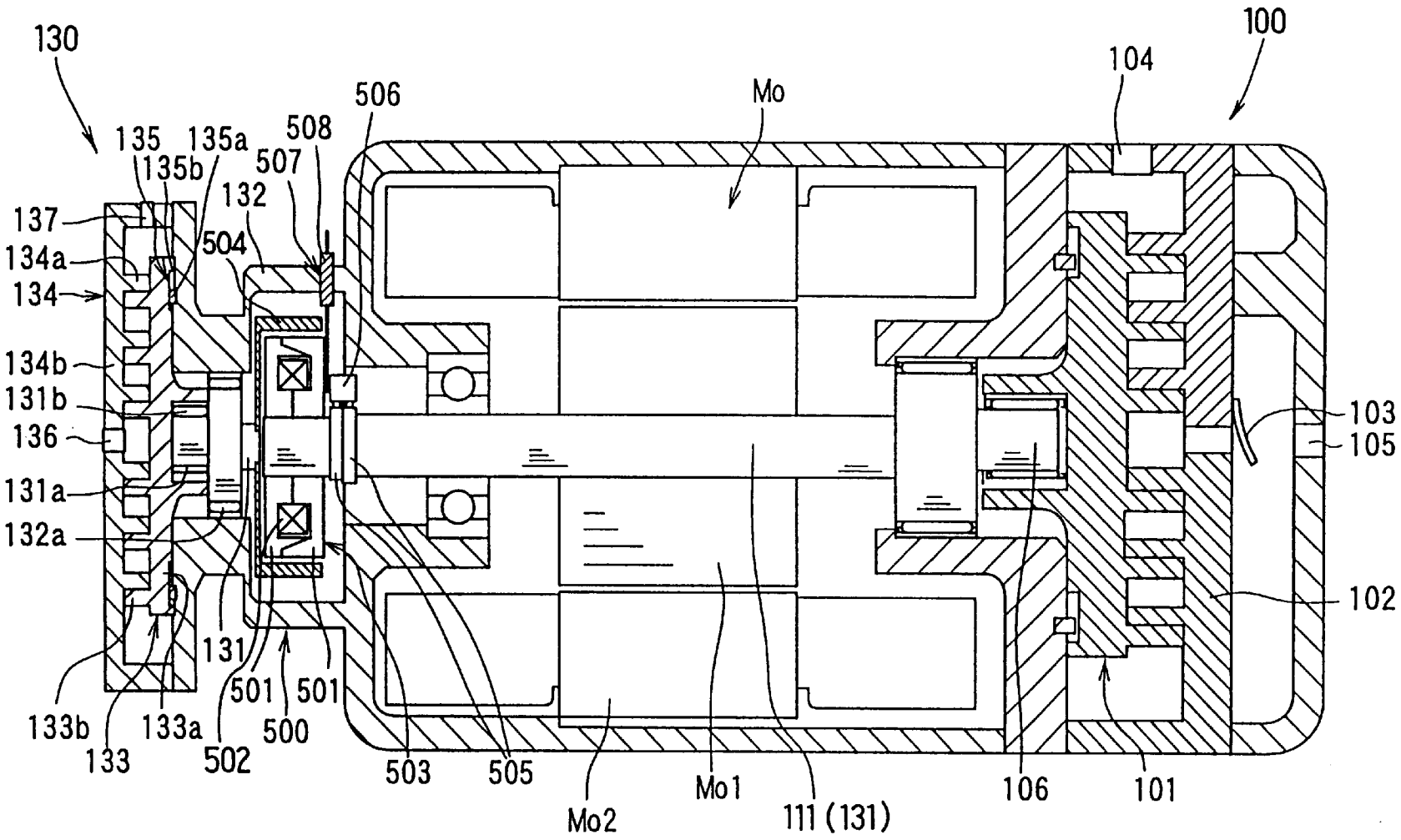
FIG. 18 is a sectional view showing an integrated structure of an expansion unit and a compressor according to the eighth embodiment of the present invention.

FIG. 18 is a sectional view showing an expansion unit-integrated compressor according to the eighth embodiment. As shown in FIG. 18, the rotor Mo1 of the electrical motor Mo and the crank portion 106 of the compressor 100 are linearly connected by the single shaft 111. Further, the expansion unit 130 is connected to the shaft 111 through an electromagnetic coupling unit 500 which transmits a driving force (mechanical energy) by electromagnetic force. Therefore, mechanical energy recovered in the expansion unit 130 is transmitted to the shaft 111 as the driving force through the electromagnetic coupling unit 500.

The electromagnetic coupling unit 500 includes a rotor 503*a* composed of a pair of rotor cores 501, and a rotor coil 502 inserted between the rotor cores 501. In the electromagnetic coupling unit 500, an approximately cylindrical cylinder 504 is disposed to face the rotor 503 to have a predetermined clearance between an inner peripheral surface of the cylinder 504 and the rotor 503 so that eddy current is generated.

Electrical power is transmitted to the rotor 503 through a slip ring 505 and brush 506 disposed in the shaft 111. Further, a seal member 508 for air-tightly sealing the housing 132 is provided in an electrode terminal 507.

Next, control operation of a refrigerant cycle system according to the eighth embodiment will be now described. In the eighth embodiment, similarly to the above-described third embodiment, the necessary driving force (torque) for driving the expansion unit 130 is controlled so that the pressure of the high-pressure side refrigerant (i.e., the pressure at the outlet side of the radiator 110) is controlled.

Specifically, when the refrigerant pressure at the outlet side of the radiator 110 is smaller than the target pressure, electrical current supplying to the rotor 503 of the electromagnetic coupling unit 500 is increased, and torque to be transmitted to the electromagnetic coupling unit 500 is increased. Thus, driving force (torque) transmitting to the shaft 111 of the electrical motor Mo and the compressor 100 is increased so that a necessary driving force for driving the expansion unit 130 is increased. Therefore, the pressure of high-pressure side refrigerant (i.e., refrigerant pressure at the outlet side of the radiator 110) is increased, and the refrigerant amount flowing into the expansion unit 130 is decreased.

On the other hand, when the refrigerant pressure at the outlet side of the radiator 110 is larger than the target pressure, the electrical current supplying to the rotor 503 of the electromagnetic coupling unit 500 is decreased, and torque to be transmitted to the electromagnetic coupling unit 500 is decreased. Thus, driving force (torque) transmitting to the shaft 111 of the electrical motor Mo and the compressor 100 is decreased so that a necessary driving force for driving the expansion unit 130 is decreased. Therefore, the pressure of high-pressure side refrigerant (i.e., refrigerant pressure at the outlet side of the radiator 110) is decreased, and the refrigerant amount flowing into the expansion unit 130 is increased.

Further, when the refrigerant pressure at the outlet side of the radiator 110 is equal to the target pressure, the present electrical current supplying to the rotor 503 of the electromagnetic coupling unit 500 is maintained.

A ninth preferred embodiment of the present invention will be now described with reference to FIGS. 19 and 20. In the above-described eighth embodiment of the present invention, the mechanical energy recovered in the expansion valve 130 is transmitted to the shaft 111 through the electromagnetic coupling unit 500. However, in the ninth embodiment, the mechanical energy recovered in the expansion unit 130 is transmitted to the shaft 111 through a belt-type non-stage transmission unit (hereinafter, referred to as CVT) 600.

In the CVT 600, a belt pulley on which a transmission belt such as a V-belt is hung is formed by combining both conical disks. Further, one side conical disk is moved relative to the other side conical disk, so that a recess width of the belt pulley is changed and the CVT 600 is gear-shifted. The CVT 600 includes an input side pulley 601 and an outlet side pulley 607.

Figure 19:
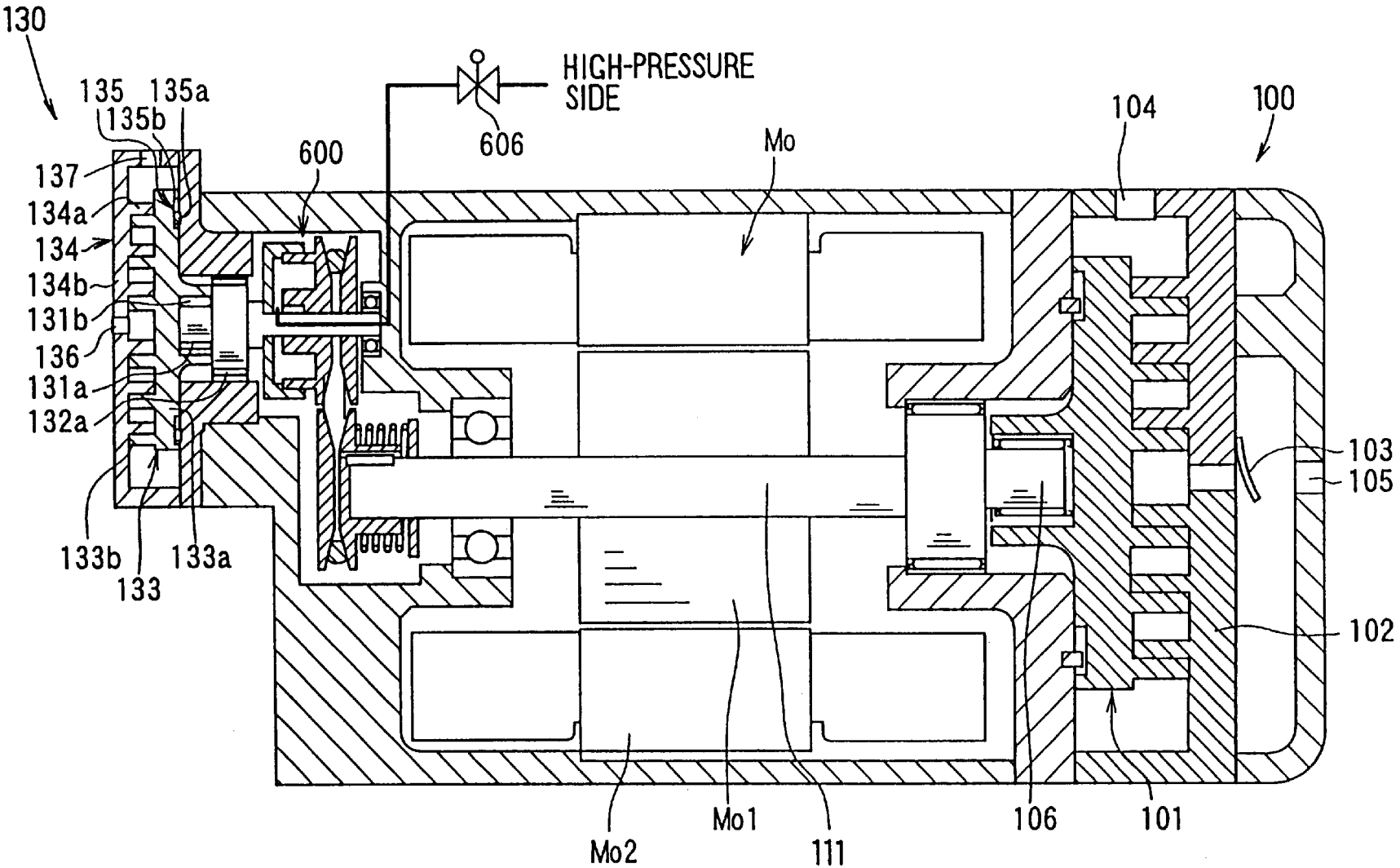
FIG. 19 is a sectional view showing an integrated structure of an expansion unit and a compressor according to a ninth preferred embodiment of the present invention.
Figure 20:
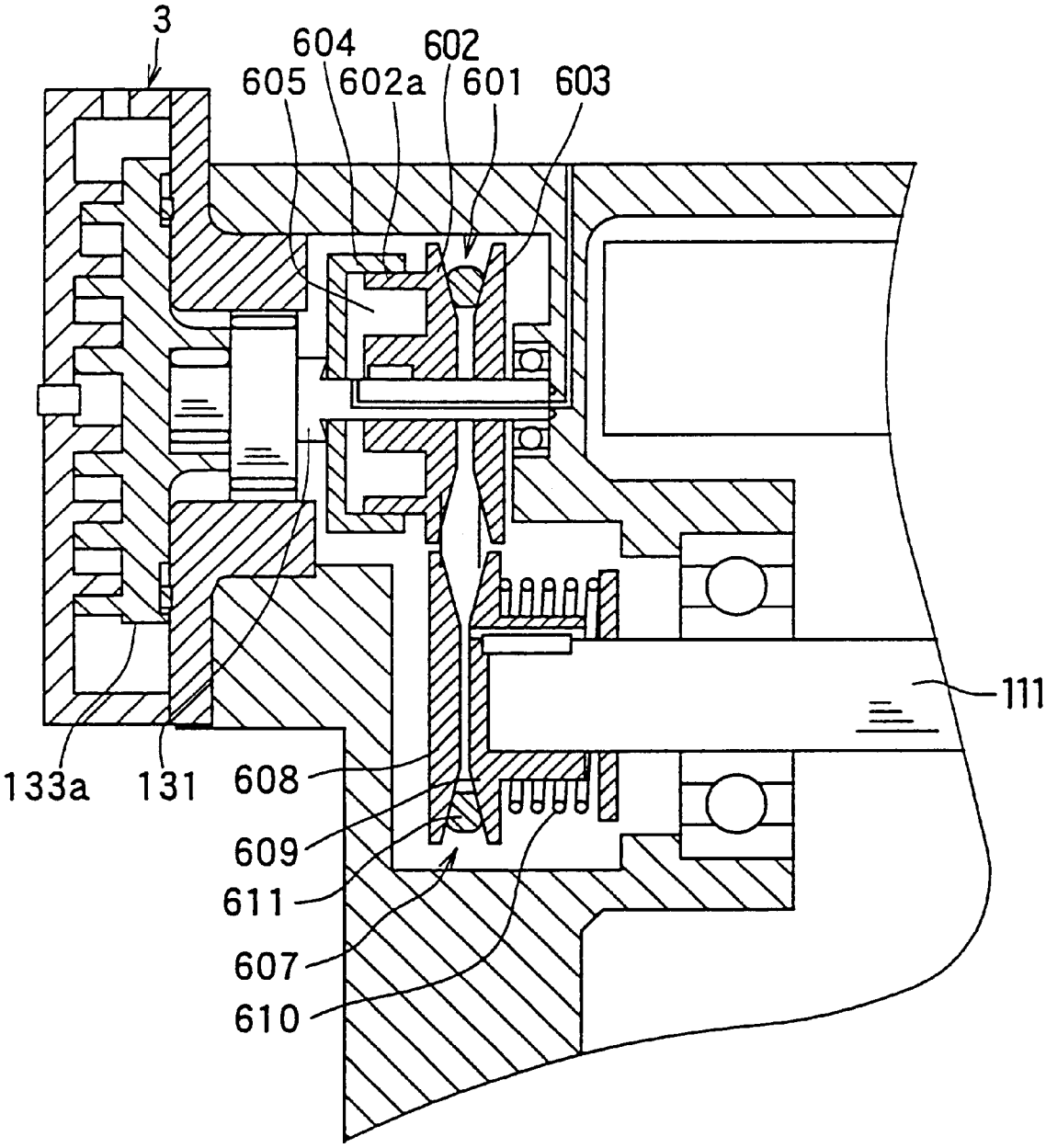
FIG. 20 is an enlarged view showing a CVT of the integrated structure of the expansion unit and the compressor according to the ninth embodiment.

FIG. 20 is an enlarged view of FIG. 19, showing the CVT 600. In the input side pulley 601, as shown in FIG. 20, within conical disks 602, 603 integrally rotated with the shaft 131 of the expansion unit 130, the disk 602 at a side of the movable scroll 133*a* is disposed to be movable relative to the shaft 131 in the axial direction of the shaft 131. Further, a pressure chamber 605 is defined by an approximately cup-like cylinder 604 and a cylindrical piston portion 602*a* formed in the disk 602 at the side of the movable scroll 133*a*. As shown in FIG. 19, the refrigerant pressure discharged from the compressor 100 is adjusted by a control valve 606 and is supplied to the pressure chamber 605, so that the recess width of the inlet side pulley 601 is controlled.

On the other hand, the outlet side pulley 607 includes a conical disk 608 integrally rotated with the shaft 111, a conical disk 609 integrally rotated with the shaft 111 to be movable in the axial direction of the shaft 111, and a coil spring 610 having an elastic force for pressing the disk 609 toward the disk 608. A V-belt 611 is hung on both the pulleys 601, 607.

Next, operation of a refrigerant cycle system according to the ninth embodiment will be now described. In the ninth embodiment, similarly to the eighth embodiment, the necessary driving force (torque) for driving the expansion unit 130 is controlled so that the refrigerant pressure at the outlet side of the radiator 110 is controlled.

Specifically, when the refrigerant pressure at the outlet side of the radiator 110 is smaller than the target pressure, the control valve 606 is adjusted so that the pressure inside the pressure chamber 605 is increased to be larger than the pressure outside the pressure chamber 605. Therefore, the disk 602 of the inlet side pulley 601 moves toward the disk 603, and the recess width between both the disks 602, 603 becomes smaller. Thus, an effective pulley radius around which the V-belt 607 is wound becomes larger, and a transmission ratio (i.e., outlet-side pulley rotation speed/input-side pulley rotation speed) of the CVT 600 becomes larger.

Thus, because the necessary driving force for driving the expansion unit 130 becomes larger, the refrigerant pressure at the outlet side of the radiator 110 is increased, and the refrigerant amount flowing into the expansion unit 130 is decreased.

On the other hand, when the refrigerant pressure at the outlet side of the radiator 110 is larger than the target pressure, the control valve 606 is adjusted so that the pressure inside the pressure chamber 605 is decreased to be smaller than the pressure outside the pressure chamber 605. Therefore, the disk 602 of the inlet side pulley 601 moves away the disk 603, and the recess width between both the disks 602, 603 becomes larger. Thus, an effective pulley radius around which the V-belt 607 is wound becomes smaller, and a transmission ratio (i.e., outlet-side pulley rotation speed/input-side pulley rotation speed) becomes smaller.

Thus, because the necessary driving force for driving the expansion unit 130 becomes smaller, the refrigerant pressure at the outlet side of the radiator 110 is decreased, and the refrigerant amount flowing into the expansion unit 130 is increased.

Further, the recess width of the outlet side pulley 607 is determined based on the effective pulley radius determined by the recess width of the inlet side pulley 601, the tension of the V-belt 611 and the elastic force of the coil spring 610.

A tenth preferred embodiment of the present invention will be now described with reference to FIG. 21. In the above-described ninth embodiment, the CVT 600 is disposed in a driving-force transmission path from the expansion unit 130 to the compressor 100, and a transmission ratio of the CVT 600 is controlled, so that the driving force for driving the compressor 100, that is, the necessary driving force for driving the expansion unit 130 is controlled. However, in the tenth embodiment, a variable-capacity type expansion unit 130 in which a refrigerant suction amount is changed is used.

Figure 21:
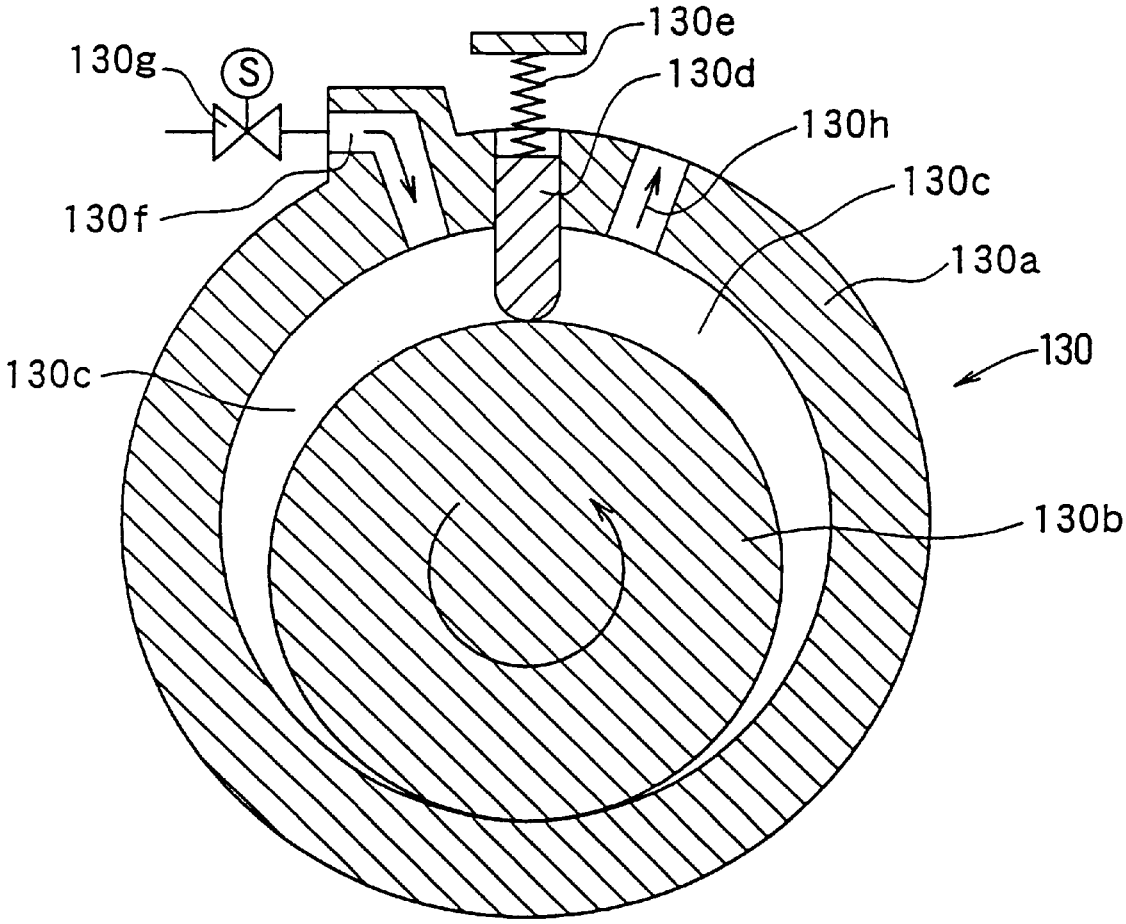
FIG. 21 is a sectional view of an expansion unit according to a tenth preferred embodiment of the present invention.

In the tenth embodiment, as shown in FIG. 21, the variable-capacity type expansion unit 130 includes a cylindrical housing 130*a*, and a low-ring piston 130*b* rotated in the housing 130*a* to be offset from the center of the housing 130. An operation chamber 130*c* is defined by the low-ring piston 130*b* and the housing 130*a*, and is partitioned by a vane 130*d* into a refrigerant suction side and a refrigerant discharge side. Further, a spring 130*e* is attached to the vane 130*d* so that the vane 130*d* is pressed to the low-ring piston 130*b*. Further, the variable-capacity type expansion unit 130 includes a suction port 130*f* for sucking refrigerant, a valve 130*g* for opening and closing the suction port 130*f*, and a discharge port 130*h* for discharging refrigerant.

When the refrigerant pressure at the outlet side of the radiator 110 is smaller than the target pressure, a closing timing for closing the suction port 130*f* is made earlier. Therefore, the refrigerant amount flowing into the expansion unit 130 is decreased, and the refrigerant pressure at the outlet side of the radiator 110 is increased to be equal to the target pressure.

On the other hand, when the refrigerant pressure at the outlet side of the radiator 110 is larger than the target pressure, the closing timing for closing the suction port 130*f* is made later. Therefore, the refrigerant amount flowing into the expansion unit 130 is increased, and the refrigerant pressure at the outlet side of the radiator 110 is decreased to be equal to the target pressure.

Although the present invention has been fully described in connection with the preferred embodiments thereof with reference to the accompanying drawings, it is to be noted that various changes and modifications will become apparent to those skilled in the art.

In the above-described first embodiment, both the compressors 100, 140 are used. However, after the main-flow refrigerant and the supplementary-flow refrigerant are joined, the joined refrigerant is compressed by a single compressor using the recovered mechanical energy from the expansion unit 130.

In the above-described second embodiment, the scroll type energy conversion unit 220 and the scroll type compression unit 230 are used. However, the other type energy conversion unit and compressor such as a piston-type energy conversion unit and a piston type compressor may be used.

In the above-described second embodiment, the expansion energy (heat energy) is directly converted to the mechanical energy. However, after the expansion energy is converted to electrical energy, the electrical energy may be converted to the mechanical energy to operate the second compressor 140. Further, in this case, by controlling the magnetic field of a generator for converting the expansion energy to the electrical energy, a decompression degree of the expansion unit 130 is controlled so that the refrigerant pressure at the outlet side of the radiator 110 is controlled.

Further, instead of the stable throttle 122, a movable throttle which changes a throttle opening degree in accordance with operation state of the refrigerant cycle system may be used. In this case, the movable throttle is controlled so that the throttle opening degree is increased when the heat load or the circulation refrigerant amount is increased.

In the above-described third through tenth embodiments, the refrigerant temperature at the high-pressure side refrigerant is directly detected. However, a physical amount relative to the refrigerant temperature of the high-pressure side refrigerant, such as the outside air temperature or the temperature of a refrigerant pipe may be used instead of the directly detected refrigerant temperature.

In the above-described fifth through tenth embodiments, the refrigerant capacity discharged from the compressor 100 is fixed. However, a capacity variable compressor which changes the refrigerant capacity discharged from the compressor 100 may be used, so that the necessary driving force (torque) for driving the expansion unit 130 may be controlled and the refrigerant pressure at the outlet side of the radiator 110 may be controlled.

In the above-described ninth embodiment of the present invention, the CVT 600 is used as a transmission unit. However, a toroidal method without using a belt may be used as the transmission unit.

Figure 22A:
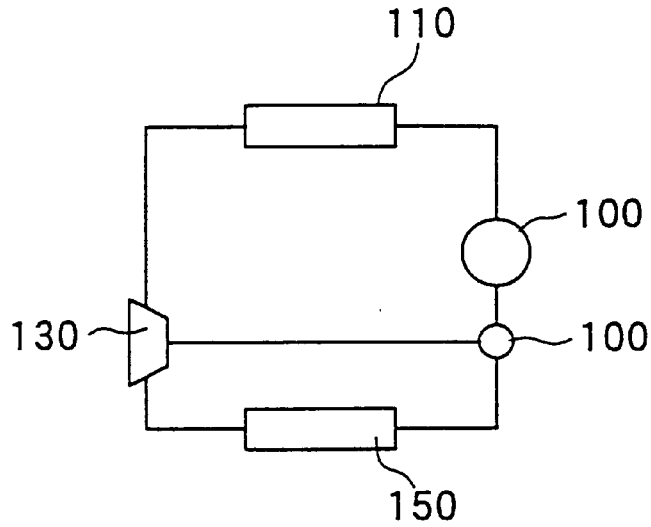
FIGS. 22A, 22B, 22C are schematic views each showing a refrigerant cycle system according to a modification of the present invention.
Figure 22B:
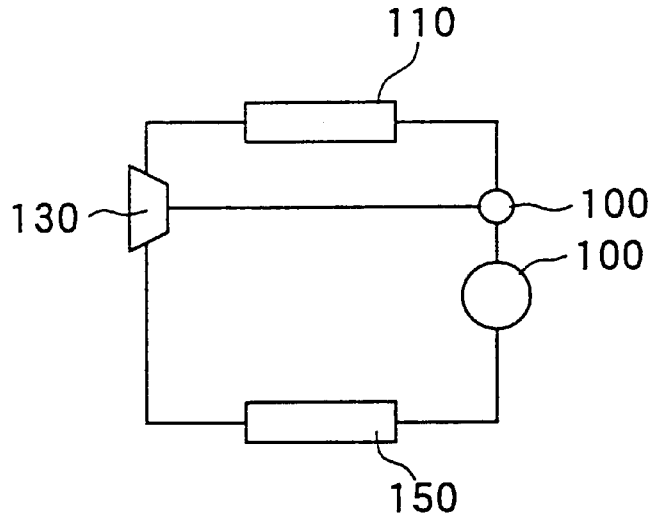
Figure 22C:
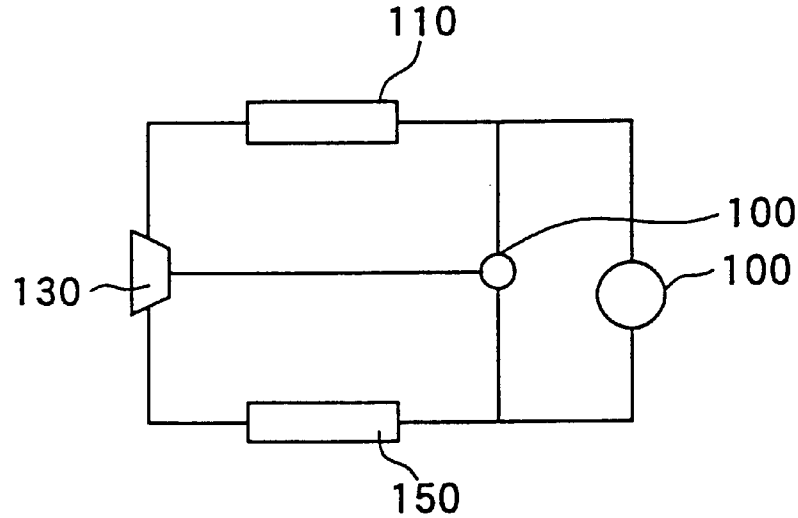

Further, as shown in FIGS. 22A, 22B, 22C, plural compressors 100 may be provided, and only one compressor 100 may be driven by the energy converted in the expansion unit 130. In FIGS. 22A, 22B, the plural compressors 100 are disposed in series in a refrigerant cycle system. On the other hand, in FIG. 22C, the plural compressors 100 are disposed in parallel in a refrigerant cycle system.

Such changes and modifications are to be understood as being within the scope of the present invention as defined by the appended claims.

What is claimed is:

1. A refrigerant cycle system comprising:

a compressor for compressing refrigerant;

a radiator for cooling refrigerant discharged from said compressor, said radiator having therein a pressure higher than the critical pressure of refrigerant;

an expansion-energy recovering unit for decompressing and expanding refrigerant discharged from said radiator in a refrigerant expansion, and for converting expansion energy during the refrigerant expansion to mechanical energy to supply the mechanical energy to said compressor, said expansion-energy recovering unit being integrated with said compressor such that said expansion-energy recovering unit and said compressor are rotated with the same rotation speed;

an evaporator for evaporating refrigerant decompressed in said expansion-energy recovering unit;

a control unit for controlling a parameter relative to operation of said expansion-energy recovering unit to control a pressure of high-pressure side refrigerant having been compressed by said compressor and before being decompressed;

a pressure detection unit for detecting the pressure of high-pressure side refrigerant;

a temperature detection unit for detecting the temperature of the high-pressure side refrigerant; and a control valve disposed at an upstream side of said expansion-energy recovering unit in a refrigerant flow direction to control the pressure of the high-pressure side refrigerant based on the temperature of the high-pressure side refrigerant detected by the temperature detection unit.

2. The refrigerant cycle system according to claim 1, wherein said parameter controlled by said control unit is an energy amount recovered during the refrigerant expansion of said expansion unit to control the pressure of the high-pressure side refrigerant.

3. The refrigerant cycle system according to claim 1, wherein said parameter controlled by said control unit is a refrigerant amount flowing through said expansion unit to control the pressure of the high-pressure side refrigerant.

4. The refrigerant cycle system according to claim 1, wherein:

said expansion unit is a capacity-variable type in which a refrigerant amount sucked therein is variable; and said parameter controlled by said control unit is the refrigerant amount sucked into said expansion unit to control the pressure of the high-pressure side refrigerant.

5. The refrigerant cycle system according to claim 1, wherein said parameter controlled by said control unit is a driving force which is necessary for driving said expansion unit, to control the pressure of the high-pressure side refrigerant.

6. The refrigerant cycle system according to claim 1, wherein said control unit controls the pressure of the high-pressure side refrigerant to become a target pressure determined based on the refrigerant temperature detected by the temperature detection unit.

7. The refrigerant cycle system according to claim 1, wherein:

said compressor includes a shaft and a scroll-type compression portion operated by the shaft; and the expansion-energy recovering unit includes a scroll-type expansion portion operated by the same shaft as the compressor.

8. The refrigerant cycle system according to claim 1, wherein said control valve is disposed between said radiator and said expansion-energy recovering unit in the refrigerant flow direction.

9. The refrigerant cycle system according to claim 8, wherein said pressure detection unit and said temperature detection unit are provided between said radiator and said control valve in the refrigerant flow direction.

10. The refrigerant cycle system according to claim 1, wherein control valve is disposed in a refrigerant passage through which refrigerant from said radiator bypasses said expansion-energy recovering unit.

11. A refrigerant cycle system comprising:

a compressor for compressing refrigerant;

a radiator for cooling refrigerant discharged from said compressor, said radiator having therein a pressure higher than the critical pressure of refrigerant;

an expansion-energy recovering unit for decompressing and expanding refrigerant discharged from said radiator in a refrigerant expansion, and for converting expansion energy during the refrigerant expansion to mechanical energy to supply the mechanical energy to said compressor, said expansion-energy recovering unit being integrated with said compressor such that said expansion-energy recovering unit and said compressor are rotated with the same rotation speed;

an evaporator for evaporating refrigerant decompressed in said expansion-energy recovering unit, to which refrigerant from said radiator is introduced through a refrigerant passage;

a throttle unit for adjusting an opening area of said refrigerant passage, disposed in said refrigerant passage;

a pressure detection unit for detecting a pressure of high-pressure side refrigerant discharged from said compressor, said pressure detection unit being disposed at an upstream side of said throttle unit in a refrigerant flow direction;

a temperature detection unit for detecting the temperature of the high-pressure side refrigerant; and a control unit which controls an opening degree of said throttle unit to control the pressure of high-pressure side refrigerant based on the temperature of the high-pressure side refrigerant detected by the temperature detection unit.

12. The refrigerant cycle system according to claim 11, wherein said throttle unit is disposed at a refrigerant upstream side from said expansion unit in said refrigerant passage.

13. The refrigerant cycle system according to claim 11, wherein said throttle unit is disposed at a refrigerant downstream side from said expansion unit in said refrigerant passage.

14. The refrigerant cycle system according to claim 11, wherein:

said refrigerant passage include a refrigerant bypass passage through which refrigerant flowing from said radiator is directly introduced into said evaporator while bypassing said expansion unit; and said throttle unit is disposed in said refrigerant bypass passage.

15. The refrigerant cycle system according to claim 11, wherein;

the temperature detection unit detects the temperature of refrigerant at an outlet of said radiator; and said control unit controls the pressure of the high-pressure side refrigerant to become a target pressure determined based on the refrigerant temperature at the outlet of said radiator.

16. The refrigerant cycle system according to claim 11, wherein:

said compressor includes a shaft and a scroll-type compression portion operated by the shaft; and the expansion-energy recovering unit includes a scroll-type expansion portion operated by the same shaft as the compressor.

17. A refrigerant cycle system comprising:

a compressor for compressing refrigerant;

a radiator for cooling refrigerant discharged from said compressor, said radiator having therein a pressure higher than the critical pressure of refrigerant;

an expansion-energy recovering unit for decompressing and expanding refrigerant discharged from said radiator, and for recovering expansion energy during a refrigerant expansion, said expansion-energy recovering unit being disposed to supply the recovered expansion energy to said compressor;

an evaporator for evaporating refrigerant decompressed in said expansion-energy recovering unit;

a control unit for controlling a driving force for driving said compressor;

a pressure detection unit for detecting the pressure of high-pressure side refrigerant;

a temperature detection unit for detecting the temperature of the high-pressure side refrigerant; and a control valve disposed at an upstream side of said expansion-energy recovering unit in a refrigerant flow direction to control the pressure of the high-pressure side refrigerant based on the temperature of the high-pressure side refrigerant detected by the temperature detection unit.

18. The refrigerant cycle system according to claim 17, further comprising:

a transmission unit disposed in a transmitting path through which the driving force is transmitted from said expansion unit to said compressor, wherein said control unit controls a transmission ratio of said transmission unit to control the driving force for driving said compressor.

19. The refrigerant cycle system according to claim 17, further comprising:

an electromagnetic coupling unit for transmitting the driving force from said expansion unit to said compressor by an electromagnetic force, wherein said control unit controls said electromagnetic coupling unit to control the driving force for driving said compressor.

20. The refrigerant cycle system according to claim 17, wherein:

said compressor is a capacity-variable type in which a discharged refrigerant amount is variable;

said control unit controls the refrigerant amount discharged from said compressor to control the driving force for driving said compressor.

21. The refrigerant cycle system according to claim 17, wherein said expansion unit and said compressor are an integrated member.

22. The refrigerant cycle system according to claim 17, wherein said control unit controls the pressure of the high-pressure side refrigerant to become a target pressure determined based on the refrigerant temperature detected by the temperature detection unit.

23. The refrigerant cycle system according to claim 17, wherein the control valve is disposed between said radiator and said expansion-energy recovering unit in the refrigerant flow direction.

* * * * *